US012485467B2

(12) United States Patent
Miglioranza

(10) Patent No.: US 12,485,467 B2
(45) Date of Patent: Dec. 2, 2025

(54) METHOD AND APPARATUS FOR PROCESSING BARS

(71) Applicant: SCHNELL S.P.A, Colli al Metauro (IT)

(72) Inventor: Aronne Miglioranza, Colli al Metauro (IT)

(73) Assignee: SCHELL S.P.A., Colli Al Metauro (IT)

( * ) Notice: Subject to any disclaimer, the term of this patent is extended or adjusted under 35 U.S.C. 154(b) by 113 days.

(21) Appl. No.: 18/006,740

(22) PCT Filed: Apr. 29, 2022

(86) PCT No.: PCT/IT2022/050116
§ 371 (c)(1),
(2) Date: Jan. 25, 2023

(87) PCT Pub. No.: WO2022/234608
PCT Pub. Date: Nov. 10, 2022

(65) Prior Publication Data

US 2024/0051009 A1 Feb. 15, 2024

(30) Foreign Application Priority Data

May 6, 2021 (IT) ..... 102021000011660

(51) Int. Cl.
*B21D 43/10* (2006.01)
*B21D 43/00* (2006.01)

(52) U.S. Cl.
CPC ..... *B21D 43/006* (2013.01); *B21D 43/10* (2013.01)

(58) Field of Classification Search
CPC ..... B21D 7/02; B21D 7/024; B21D 43/006; B21D 43/10; B21D 43/105
See application file for complete search history.

(56) References Cited

U.S. PATENT DOCUMENTS

| | | | | |
|---|---|---|---|---|
| 7,891,225 | B2 * | 2/2011 | Hammerer | B21F 1/00 72/422 |
| 10,150,154 | B2 * | 12/2018 | Hughes, Jr. | B21D 43/006 |
| 10,639,693 | B2 | 5/2020 | Yogo et al. | |

FOREIGN PATENT DOCUMENTS

| | | | |
|---|---|---|---|
| DE | 2927753 | A1 | 2/1981 |
| EP | 0419441 | A1 | 3/1991 |
| EP | 0419441 | B1 | 4/1995 |
| EP | 1291094 | B1 | 3/2003 |
| EP | 1296780 | A1 | 4/2003 |
| EP | 1375022 | A2 | 1/2004 |
| EP | 1375022 | B1 | 10/2005 |
| WO | 0191936 | A1 | 12/2001 |

OTHER PUBLICATIONS

WO 2020/089954A1, Miglioranza Feb. 2020.*
CN 110883147A, Liu Mar. 2020.*
EP 2598266B1, Rupoli Dec. 2014.*

* cited by examiner

*Primary Examiner* — Edward T Tolan
(74) *Attorney, Agent, or Firm* — McGlew and Tuttle, P.C.

(57) ABSTRACT

The method for processing bars provides for feeding a predefined number of bars (2) into a feeding station (3). The method further provides for transferring said fed bars to an operating assembly (4) by means of a transfer assembly (5) comprising at least one transfer device (50).

23 Claims, 34 Drawing Sheets

Fig.14c
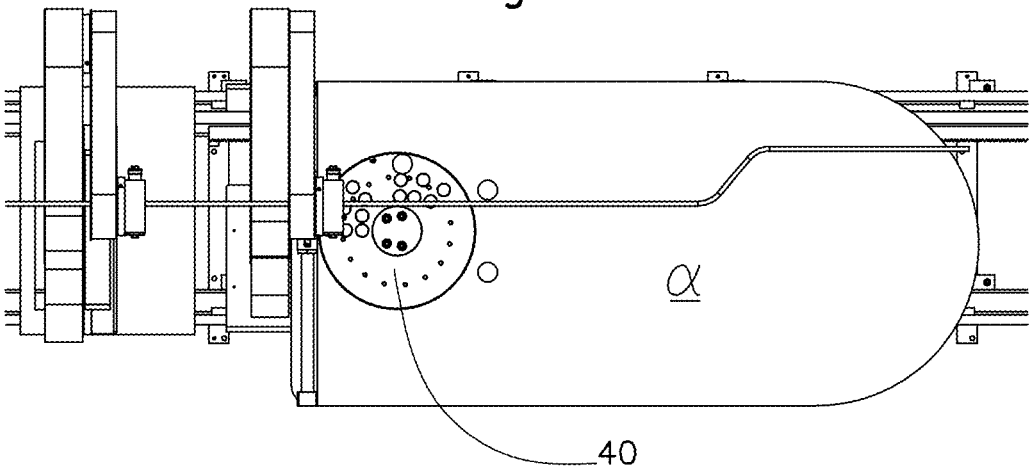
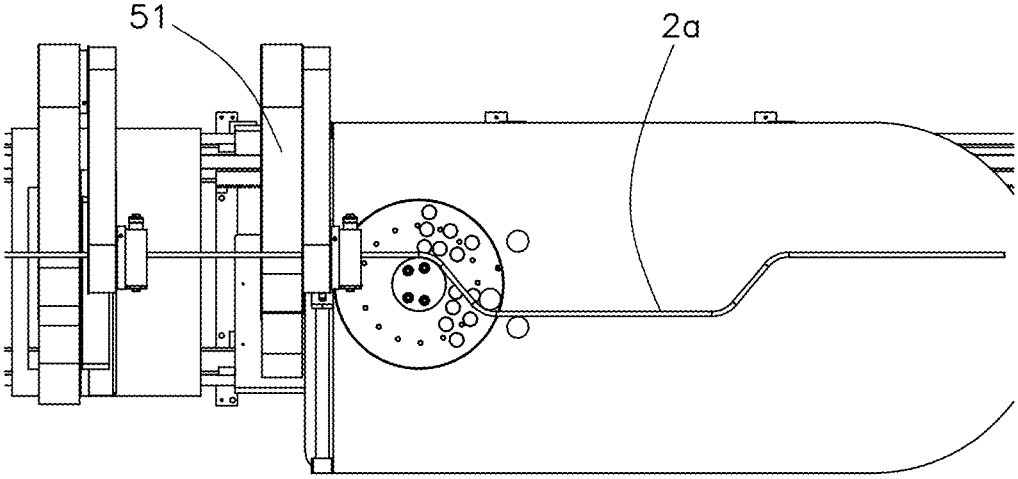
Fig.14d

METHOD AND APPARATUS FOR PROCESSING BARS

TECHNICAL FIELD

The present invention relates to a method and an apparatus for processing, in particular for bending bars, in particular steel rods for reinforced concrete, obtained by cutting from bars or rolls.

PRIOR ART

The use of steel bars commonly called "steel", bent at one or opposite ends, in this latter case called "rebars", or rods bent into a substantially closed section bar, called "stirrups" or "long stirrups" depending on the size, for making reinforcing bars for reinforced concrete is known. In order to make these products, apparatuses are generally used which submit the ends of the straight or pre-straightened steel rod to a suitable series of bends. More specifically, bending apparatuses known as "bending robots" are currently known, which permit to produce shaped products, stirrups or "long stirrups", starting from section bars already cut to a certain length suitable for the size of the shaped elements to be made.

These apparatuses usually comprise a feed path with motorized rollers, used to feed the bars to be shaped; manual, automatic or semi-automatic transfer or loading means for the bars, and a pair of bending units, each carrying a bending head dedicated to shaping of a respective end of the loaded bars.

In particular, each bending head comprises a bending tool normally consisting of a central bending spindle and an eccentric bending pin, as well as a stop element which prevents the work piece from moving.

Alternatively, according to a known solution, the bending tool consists of a double spindle crossed by a seat for the bars which also acts as an abutment during the bending step, always carried out by an eccentric pin.

In traditional apparatuses, each bending head is in any case constrained to the bending unit, which is fixed or movable in the longitudinal direction with respect to the axis of the bar to be shaped. Apparatus are known in which one bending unit is fixed, while the other is movable. Apparatuses are also known with operation similar to that described, in which both bending units are movable.

Such known apparatuses generally perform bending cycles, through a suitable alternation of the steps of bending and of relative displacing between the bending units, but they do not permit to fully automate the steps of loading and unloading of the bars.

Certain solutions have been proposed to automate, in particular, the loading of the bars to the bending units.

For example, patent EP1296780 illustrates an apparatus for bending bars, comprising a transfer mechanism equipped with pliers, for feeding the bars into a bending system, and an unloading system also equipped with pliers, for unloading the shaped bars.

Patent EP1375022, on the other hand, illustrates a plant for processing metal bars, comprising means for transferring them. In particular, the illustrated plant comprises first means for transferring the bars from a first station to a bending station and second means for transferring the bars, once bent, from the bending station to an unloading station. The first transfer means comprises a support frame and one or more gripping members. These members in turn comprise a support structure guided on the support frame so as to be movable relative to the bending station in a first horizontal direction parallel to the longitudinal direction of the bars and along a second direction, horizontal and perpendicular to the longitudinal direction of the bars. Each gripping member also comprises a pair of jaws mounted on a wrist which in turn is articulated to the support structure of the gripping member, rotatable around a substantially horizontal articulation axis.

Finally, European patent EP0419441 shows an apparatus for bending bars, comprising two bending units each equipped with a gripping member, with the function of transferring member, oscillating between a receiving position and an inserting position at which the bars are inserted in the space between the two bending units.

However, the known solutions do not fully satisfy the needs of the specific sector, since they generally have a complex structure, which is therefore bulky and expensive.

Furthermore, the known apparatuses cannot offer the versatility required by the production requirements, since they require different devices, to allow both the loading of the bars to be bent and the unloading of the bent products to take place in an orderly manner. In fact, during the loading step, it is important that the bars are quickly inserted between the bending units, that is, for example, all together, in a specific number and according to a side-by-side and aligned arrangement, in order to be able to carry out the bending operations with the desired accuracy. The bars must also be effectively untangled. In other words, they must always be arranged in the same order in all sections of the length. Even in the unloading step, it is important to ensure that the bent products are transferred in an orderly manner, so as to facilitate the subsequent grouping, labeling and transporting steps and that the bars do not rotate during handling due to the weight of the bent portions, which create an overhang.

DISCLOSURE

An object of the present invention is to solve the problems mentioned in the prior art, devising a method and an apparatus for bending bars which permits to carry out, automatically and in a versatile way, the handling of the bars, optimizing the overall dimensions and productivity.

It is a further object of the present invention to provide an apparatus that carries out the aforementioned handling provided with a simple and functional structure, great flexibility of use and which is reliable in operation.

The aforementioned objects are achieved, according to the invention, by the method according to claim 1, as well as by the apparatus according to claim 7.

The method for processing bars provides for arranging a feeding station suitable for receiving the bars on a feeding plane along a longitudinal direction, at least one operating unit for processing the bars on a work surface, an unloading station for receiving on an unloading surface the processed bars, and a transfer device interposed between the feeding station and the unloading station.

The transfer device comprises an articulated arm constrained to a level below the work surface, and at least one gripping member articulated to the articulated arm at least around an orientation axis parallel to the aforementioned longitudinal direction. The gripping member comprises a receiving space in which a number of bars can be held and is movable between an open configuration in which the receiving space is open through a respective passage opening through which the number of bars can access to the receiving space of the gripping member or can be released outside the receiving space, and a closed configuration in which this receiving space is closed, to retain, in particular to tighten, the aforementioned number of bars.

The method then provides for feeding the bars on the feeding surface at the feeding station.

Subsequently, the transfer device is positioned at the feeding surface and intercepts the number of bars, operating the gripping element from the open configuration to the closed configuration.

The number of intercepted bars is then transferred to a first transfer section, activating the transfer device in a transfer motion from the feeding plane to the operating unit.

The number of bars is then released on the work surface, by operating the gripping element from the closed configuration to the open configuration.

The operating unit is then operated to process the number of bars.

The number of processed bars is taken by the gripping element, and transferred to a second transfer section, by activating the transfer device in the aforementioned transfer motion from the operating unit to the unloading station.

The number of processed bars is released on the unloading surface, by activating the gripping element from the closed configuration to the open configuration.

In one of the aforementioned steps from feeding to release onto the unloading plane, the method provides for operating the transfer device in an orientation motion, rotating the gripping member at least around the orientation axis so as to orient the gripping member with the receiving space above the passage opening.

Preferably, this orientation motion produces the overturning of the gripping member from one side to the opposite side with respect to the articulated arm.

The transfer device therefore permits to carry our a first transfer and a second transfer, in an overall path between respectively feeding and unloading stations, opposite each other with respect to the operating unit, arranged in an intermediate position between them. The operating unit, therefore, may be in this sense a crossing station.

In order to allow this crossing, the transfer device, which is interposed between the aforementioned stations, advantageously permits to take the number of bars according to any orientation and to release the same number of bars on a respective release, operative or unloading plane, in an ordered configuration, in particular resting and, in the case of a plurality of bars or machined bars, superimposed on each other, that is, stacked.

In particular, thanks to the aforementioned orientation motion, the method permits to stack, that is, neatly overlap, bars just processed on bars unloaded in a previous unloading cycle, for example so that they overlap for the entire extension. This is possible, since the receiving space which substantially defines the size of the gripping member may overlap the passage opening during the releasing step, so as not to interfere with the size of the bars already present on the release plane or on the work surface.

In particular, the aforementioned overturning of the gripping member preferably permits to take the bars from one side of the articulated arm and to release them on the other side of the same arm, overcoming their overall dimensions, so that the same overall dimensions do not interfere with the operations of handling the bars on the work surface or on the unloading plane, depending on the case.

Preferably, the overturning occurs by activating the transfer device combining rotational motions respectively around the orientation axis and an intermediate axis of articulation of the articulated arm, parallel to the orientation axis.

This combination of rotational motions may further include a rotation around a constraint axis parallel to the orientation axis, by which the articulated arm is constrained to the level below the work surface.

Preferably, this overturning occurs by rotating the second member around the intermediate axis and the first member around the constraint axis in the opposite direction, respectively.

Preferably, the step of releasing the number of processed bars involves disengaging the bars with an at least partially lifting motion from the unloading plane, thus allowing them to rest orderly on the unloading plane or to overlap other already shaped bars.

In particular, the operating unit is a bending and/or curving unit.

According to the invention, the apparatus for processing bars comprises a feeding station suitable for receiving the bars on a feeding plane along a longitudinal direction; at least one operating unit for processing the bars on a work surface; an unloading station, to receive the processed bars on an unloading surface.

The apparatus also comprises a transfer device interposed between the feeding station and the unloading station, comprising an articulated arm constrained to a level below the work surface and at least one gripping member articulated to the articulated arm at least around an axis of orientation parallel to the longitudinal direction. The gripping member of the apparatus comprises a receiving space in which a number of bars can be held and is movable between an open configuration in which the receiving space is open through a respective passage opening through which the number of bars can access the receiving space of the gripping member or can be released outside the receiving space itself, and a closed configuration in which the receiving space is closed, in order to retain, in particular tighten, the aforementioned number of bars.

The transfer device can be operated in a transfer motion to bring the gripping member in a first transfer section between the feeding station and the operating unit and in a second transfer section between the operating unit and the unloading station, to release the number of bars respectively on the work surface and on the unloading plane.

The transfer device is advantageously operable in an orientation motion at least around the orientation axis, so as to orient the gripping member with the receiving space above the passage opening.

Preferably, this orientation motion causes the gripping member to tip over from one side to an opposite side with respect to the same articulated arm.

In particular, in the orientation motion, the members that make up the articulated arm are preferably operated combining coordinated rotation and/or translation motions, so as to orient the at least one gripping member in a desired manner. The articulated arm preferably comprises a first member and a second member mutually articulated at least around an intermediate axis parallel to the orientation axis, at which the second member is articulated to at least one gripping member.

The aforementioned orientation motion preferably involves the combination of rotational motions of the respective members of the articulated arm around the orientation axis and the intermediate axis.

The articulated arm is preferably constrained to a height below the work surface at least around a constraint axis parallel to the orientation axis.

The aforementioned orientation motion preferably involves a further rotation motion of the first member around the constraint axis, to cause the gripping member to tip over.

The articulation between the members of the articulated arm preferably produces plane motions of the respective members, but, alternatively or in addition, it may include joints, in particular spherical joints, capable of producing motions in three-dimensional space.

According to a particular aspect, the transfer device can be linked to the operating unit, so as to emerge from the operating plane, following the aforementioned transfer motion, at an external side with respect to an operating head of the same unit, opposite to one interior side in which at least one retaining member for a bar being processed is arranged on the same unit.

Preferably in this case, the articulated arm may comprise a spacer member extending between the first member and the second member and/or between the second member and the gripping member, to bring the gripping member closer to an opposite internal side of the operating unit, so as to operate by this area.

The aforementioned first member of the articulated arm can be shaped like a double elbow.

The transfer device is preferably integrated with the operating unit, in particular pivoted under the work surface and substantially at the base thereof.

The transfer motion is preferably transverse to the longitudinal direction.

Preferably the apparatus comprises a further operating unit movable with respect to the operating unit along the longitudinal direction.

The operating unit is preferably a bending and/or curving unit, comprising a bending and/or curving head equipped with bending or curving members operating on the work surface, between which an insertion seat for the bars to be bent e/or curved is defined.

The gripping member can preferably be operated from the oriented configuration, in particular tipped over, in which it is arranged above the work surface or the unloading surface, so as to disengage the number of bars with an at least partially lifting motion respectively from the work surface or from the unloading surface.

The apparatus may comprise at least one further transfer device configured to cooperate with the aforementioned transfer device. This additional device is preferably aligned with the other transfer device along the longitudinal direction.

The gripping member can preferably comprise a pair of jaws, one of which at least movable with respect to the other between the open configuration and the closed configuration. At least one of them may internally comprise a recess and an end protruding portion, so that in the closed configuration a bar is clenched by the protruding portion and the remaining bars are instead received by the recess. More precisely, the clenched bar is in a position corresponding to the passage opening, defined when the gripping device is in the open configuration. In the closed configuration, the clenched bar is securely locked, in particular with respect to rotation, obstructing the aforementioned passage opening with its own transverse dimension. In this condition the clenched bar therefore performs a function of supporting and locking the rotation for the adjacent bars, held in the receiving space of the gripping member, thereby allowing the safe handling of even bent bars, therefore with a center of gravity positioned apart from the longitudinal axis of the bars themselves.

According to a particular aspect, the apparatus can comprise a plurality of mobile transfer devices along the longitudinal direction, so as to exploit the entire longitudinal extension of the unloading station, to unload the bars.

According to a particular aspect, the transfer device may comprise at least one further gripping member, carried by a further articulated member, preferably independently movable.

DESCRIPTION OF DRAWINGS

The details of the invention will become more evident from the detailed description of a preferred embodiment of the apparatus for processing, in particular bending, bars which implements the method according to the invention, shown by way of example in the accompanying drawings, wherein:

FIGS. 14*a*, 14*b*, 14*c*, 14*d* show a plan view of the apparatus in successive steps of manufacturing a so-called "truss-bar";

DESCRIPTION OF EMBODIMENTS OF THE INVENTION

Figure 1:
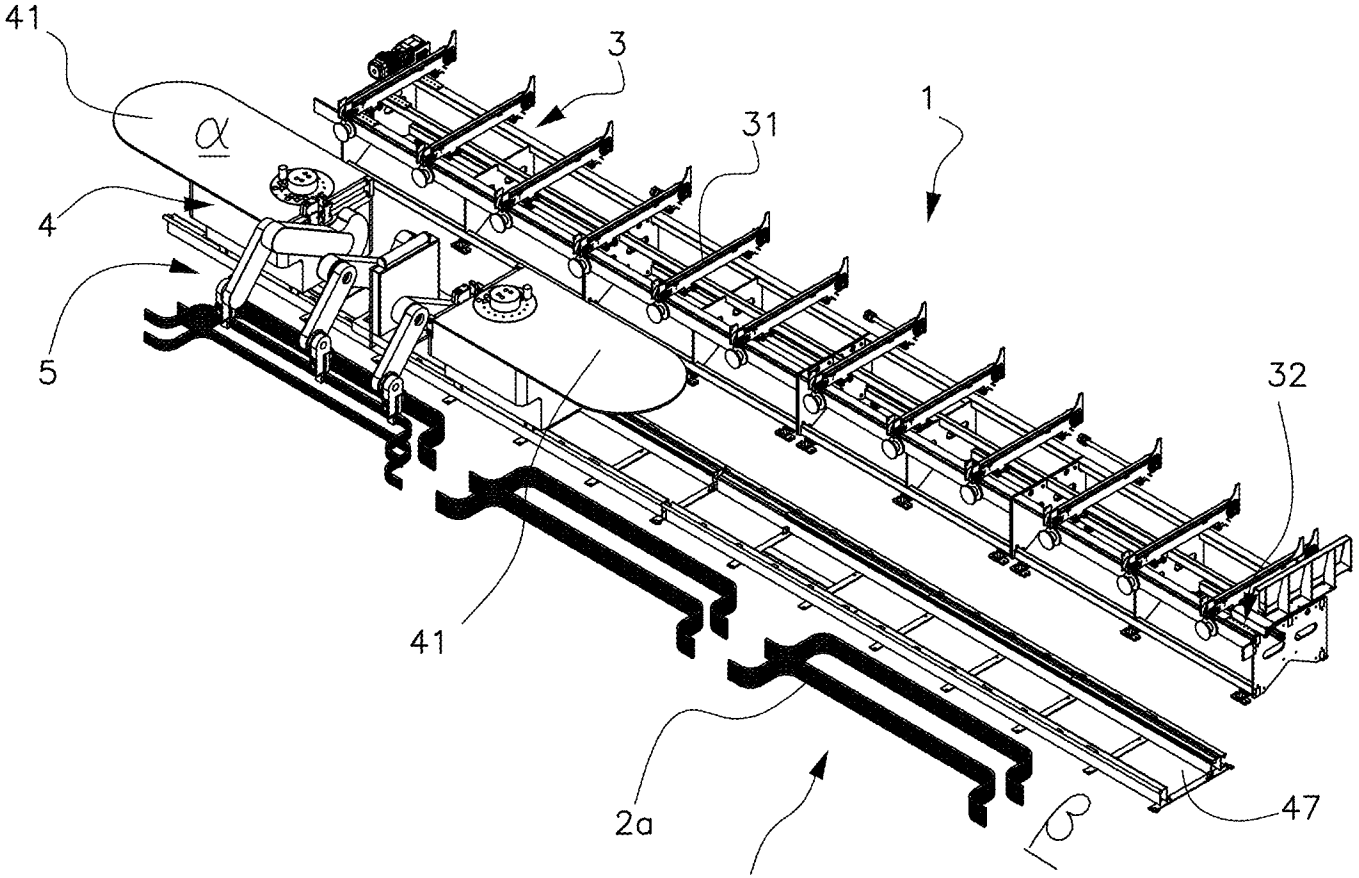
FIGS. 1 and 2 respectively show a perspective view of the apparatus according to different embodiments of an unloading station.

With particular reference to these figures, the numeral 1 indicates as a whole the apparatus for processing, in particular for bending, bars 2, in particular iron rods for reinforced concrete.

The apparatus 1 comprises a feeding station 3, at which the bars 2 intended to be bent arrive, an operating assembly comprising at least one operating unit, preferably a pair of operating units, and a transfer assembly 5 for transferring the bars 2 between various stations, as specified below, and an unloading station 6, in particular on an unloading plane β (see in particular FIG. 1).

In particular, the transfer assembly 5 is preferably arranged in an intermediate position between the feeding station 3 and the unloading station 6.

The operating assembly preferably indicates a bending unit 4 and/or curving unit, the operating units therefore being the bending unit and/or curving units 41.

The apparatus described below comprises a pair of bending units 41 and/or curving units for making, in particular, shaped and/or curved products at one or both ends, but according to the invention, apparatuses can be provided in which it is present a single bending and/or curving unit 41.

In the following the term "bending unit" will be used to indicate indifferently bending and/or curving unit.

In particular, the bending units 41 are aligned and can be activated independently, in a known way, both or one of them, along a longitudinal direction to the side of the feeding station 3.

Figure 2:
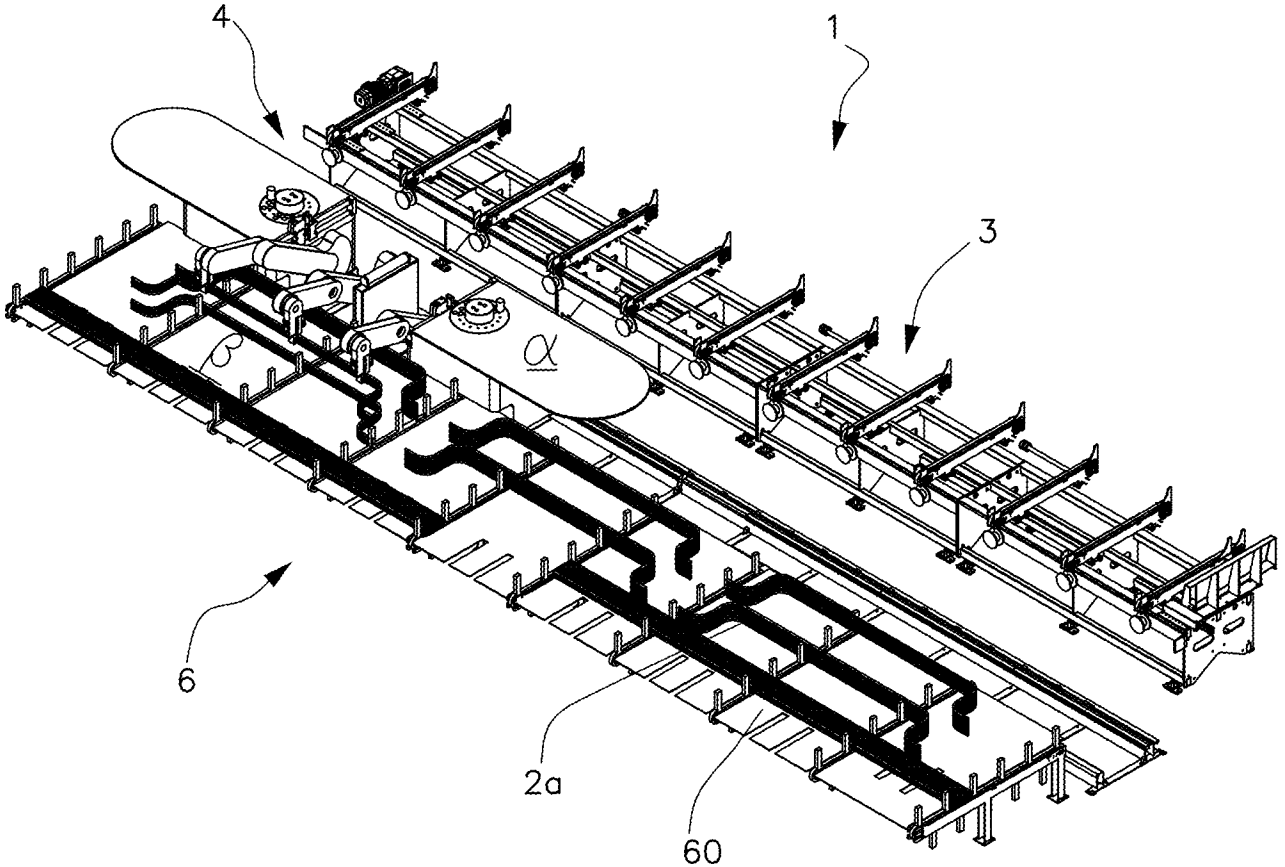

The feeding station 3 defines a feeding plane 3*a*, adapted to receive the bars 2, possibly cut to size, arranged according to the aforementioned longitudinal direction alongside the bending unit 4 (see FIG. 2). The feeding plane 3*a* can be substantially horizontal, for example.

The bars 2 can reach the feeding station 3 by means of an axial transport, for example by means of a roller conveyor, a transversal transport, for example by overturning means, or by air, for example by a bridge crane.

The feeding station 3 preferably comprises at least one transversal positioning device 31, for example of the catenary type, to allow the fed bars 2 to be moved transversely.

Preferably the feeding station 3 comprises a plurality of transversal positioning devices 31, arranged in succession, for example uniformly distributed, along the longitudinal direction, in order to allow an optimal displacement for bars 2 of any length.

Each transversal positioning device 31 can be preliminarily operated in an ordering, preferably alternating, motion, and in a transverse direction, so as to favor a distribution of the bars 2 on the feeding plane 3*a* in an ordered, untangled and leveled configuration, i.e. arranged on a single layer.

More precisely, the feeding station 3 has a longitudinal extension substantially equal to the maximum length of the bars 2 to be processed, so as to support bundles of bars 2 or single bars 2 of maximum length, arranged on the feeding plane 3*a* according to a substantially longitudinal orientation.

Figure 4A:
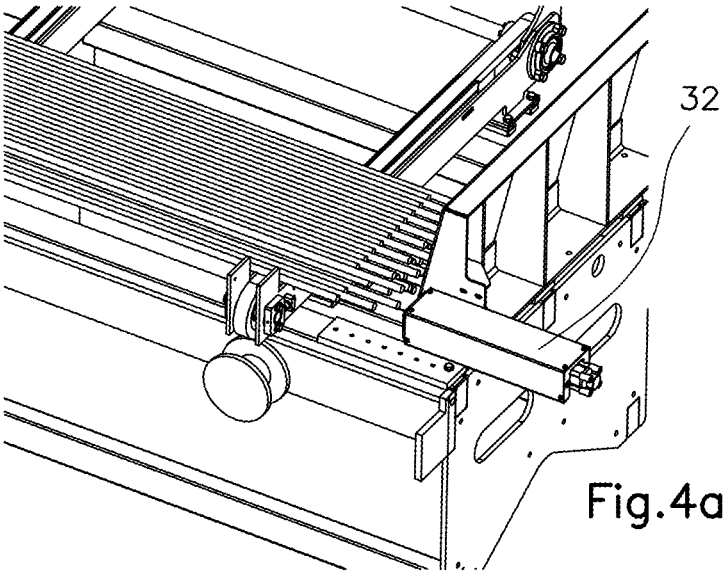
FIGS. 4*a* and 4*b* respectively show a perspective view of a detail of the invention in subsequent operating steps of the apparatus according to the invention.
Figure 4B:
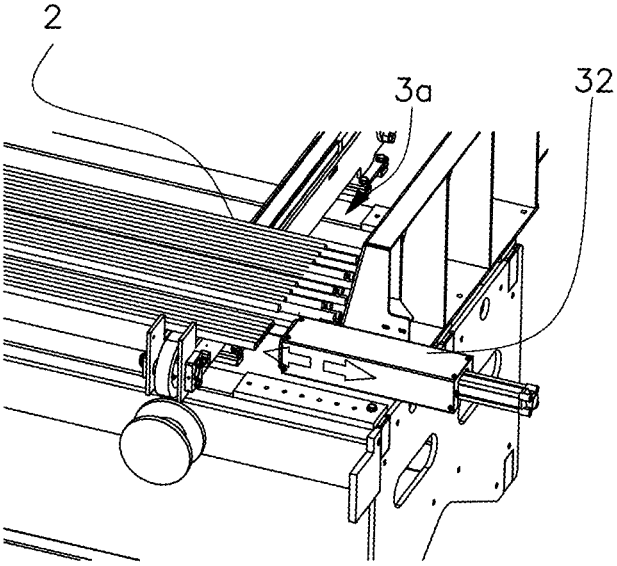

The feeding station 3 also comprises end-facing means 32 to ensure the correct alignment of the ends of all the bars 2 fed. The alignment means 32 preferably form a flat abutment wall arranged at the end of the feeding plane 3*a* and preferably movable with an alternative alignment motion along the longitudinal direction so as to perform a hammering action on one or more bars at the same time (see FIGS. 4*a* and 4*b*).

Figure 5:
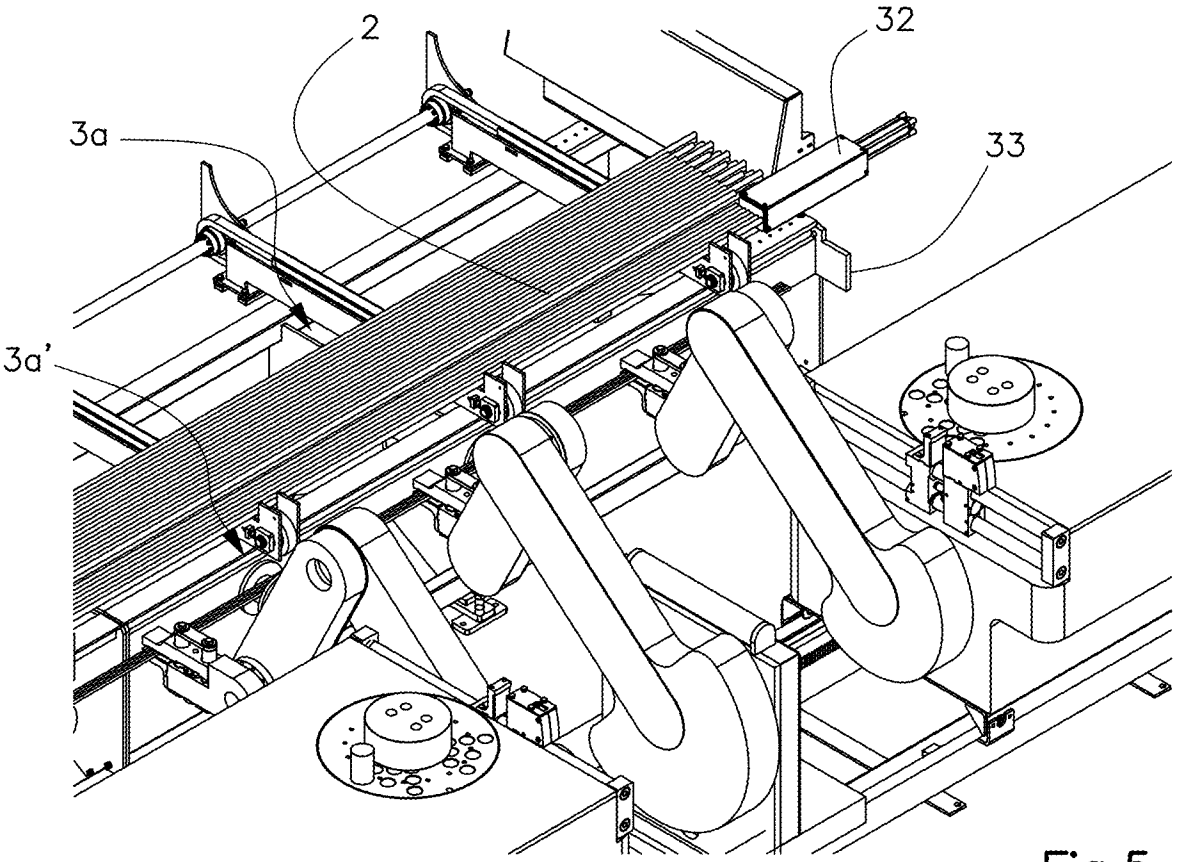
FIG. 5 shows a perspective view of a portion of the apparatus in the same operating step shown in FIGS. 4*a* and 4*b*, in a different embodiment of the feeding station of the apparatus according to the invention.

According to a particular embodiment of the feeding station 3, illustrated in FIG. 5, it is possible to provide, at the side of the feeding surface 3*a*, at least one additional receiving surface 3*a*' dedicated to receiving cut-to-size bars coming from a further source, for example from a straightener. This additional receiving surface 3*a*' can be associated with additional squaring means 33, arranged at the end of the same, to ensure the correct alignment of the bars 2 positioned thereon and intended to be bent by the bending unit 4. Said alignment means can be similar to the squaring means 32 or for example form a fixed abutment wall. In this case an alignment motion in the longitudinal direction, against the above mentioned wall, can be made in cooperation with the transfer assembly 5, to bring the bars 2 to abut said wall.

The bending units 41 are arranged at the side of the feeding station 3 and each carry, in a known way, a bending head 40.

Each bending unit 41 operates on a work surface α, on which the bars 2 can be placed and bent by bending members.

Each bending head 40 can be of any type. For example, the bending head 40 can provide a bending tool consisting of a central bending spindle 42 associated with an eccentric bending pin 43 (see FIGS. 8*a* to 8*d*), in addition to an abutment 44 suitable for locking in suitable way the piece being processed (see FIGS. 9*a* to 9*g*).

Alternatively, for example, the bending head 40 can carry a double spindle 45 crossed by a seat for the bars 2 and the same eccentric bending pin 43, movable around the double spindle 45 for bending the interposed material, in addition to the abutment 44 suitable for blocking the piece being processed in a suitable way (see FIGS. 13*a* to 13*f*).

The abutment 44 is preferably also provided in the case in which the bending head 40 comprises the central spindle 42 and the eccentric bending pin 43.

Figures 8A, 8B, 8C:
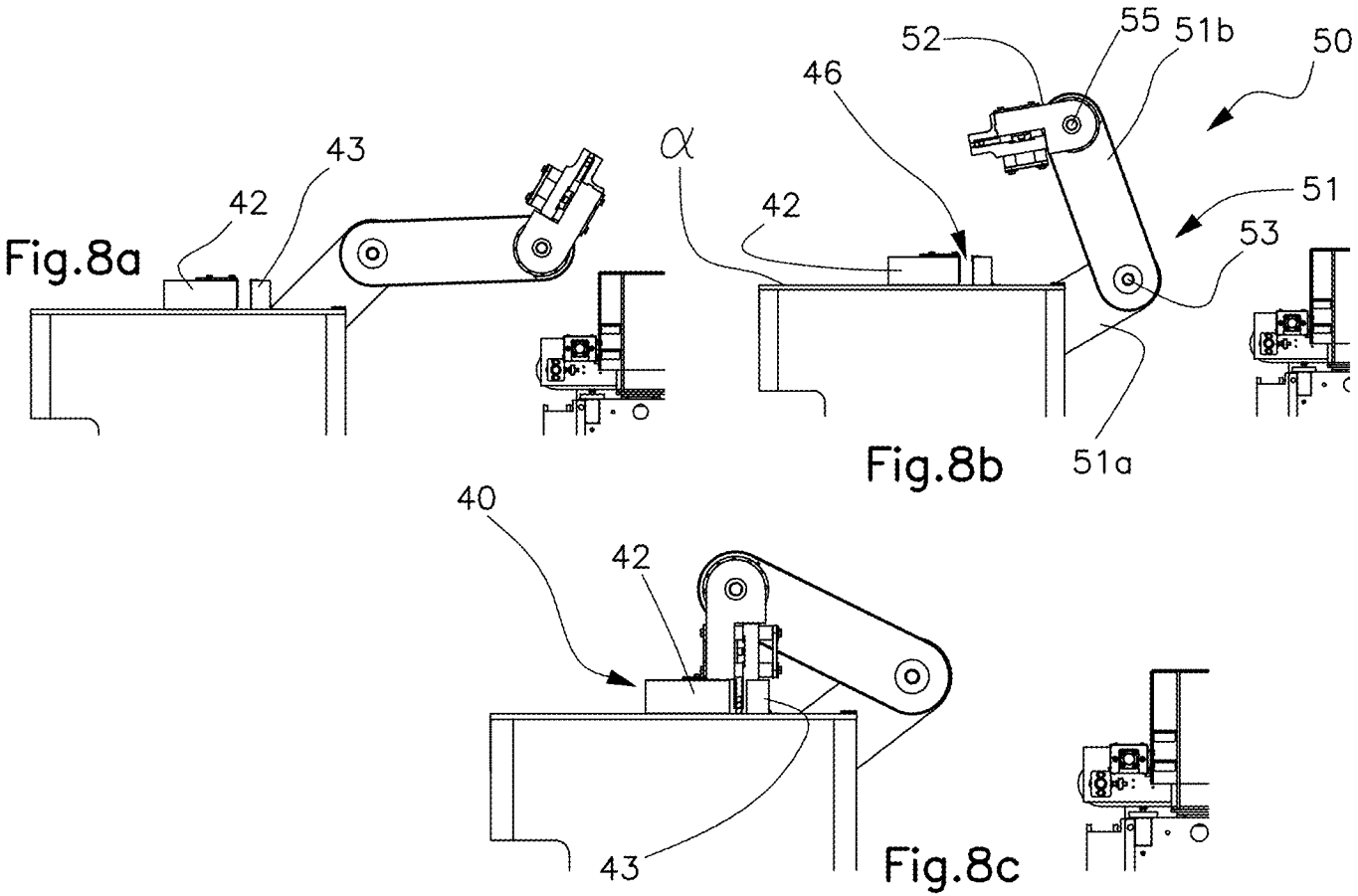
FIGS. 8*a*, 8*b*, 8*c* respectively show a side view of the apparatus according to the invention in subsequent operating steps of transferring the bars.

In any case, between the bending members, central spindle 42 and eccentric pin 43 or between double spindle 45 and eccentric pin 43, an insertion seat 46 is defined for the bars 2, at which, when the bars 2 are correctly housed therein, the eccentric pin 43 acts in cooperation with the respective bending member, causing the desired bending of a respective portion of the bars 2 (see in particular FIG. 8*b*).

In practice, the eccentric pin 43 is configured to bend a number of bars 2 which is inserted inside the insertion seat 46, rotating around the central spindle 42 or the double spindle 45, being movable in a part of the work surface α, opposed to abutment 44.

The abutment 44 is in turn configured to retain respective portions of the aforementioned number of bars 2 in the step of bending carried out by the eccentric pin 43. These portions are not intended to be engaged in the same bending step by the eccentric pin 43.

The bending units 41 are movable with a relative translation motion along the longitudinal direction to position the bars 2 between them. More precisely, at least one bending unit 41 is movable with the aforementioned translation motion along respective guide rails 47 (see FIG. 1), in such a way as to adapt the position along the longitudinal axis, as a function of the length of the bar 2 to be processed and the geometry to be obtained.

More precisely, the apparatus according to the invention permits to bend a plurality of bars 2 at each bending cycle, but it can also be used to bend one bar 2 at a time.

The transfer assembly 5 comprises at least one transfer device 50 preferably mounted integral, therefore integrated, with a respective bending unit 41. For example, the transfer device 50 can be constrained, in particular pivoted, on the internal side or, as described below, on the external side, with respect to the longitudinal direction and to an opposite bending unit 41.

The internal side is intended as the side of the bending unit 41 in which the abutment 44 is fixed, while the external side is the opposite side, in which the eccentric pin 43 operates, to bend the number of bars 2 inserted in the insertion seat 46.

Preferably, the transfer unit 5 comprises a transfer device 50 serving each bending unit 41 (see FIG. 8*b*).

Figure 13A:
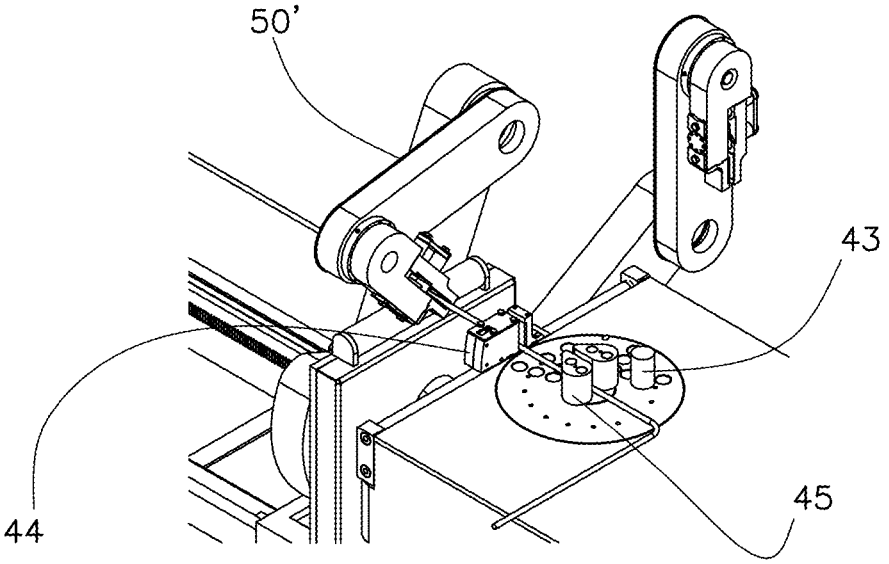
FIGS. 13*a*, 13*b*, 13*c*, 13*d*, 13*e*, 13*f* show a perspective view of a portion of the apparatus in successive operating steps of manufacturing a bar with three-dimensional bends.
Figure 13B:
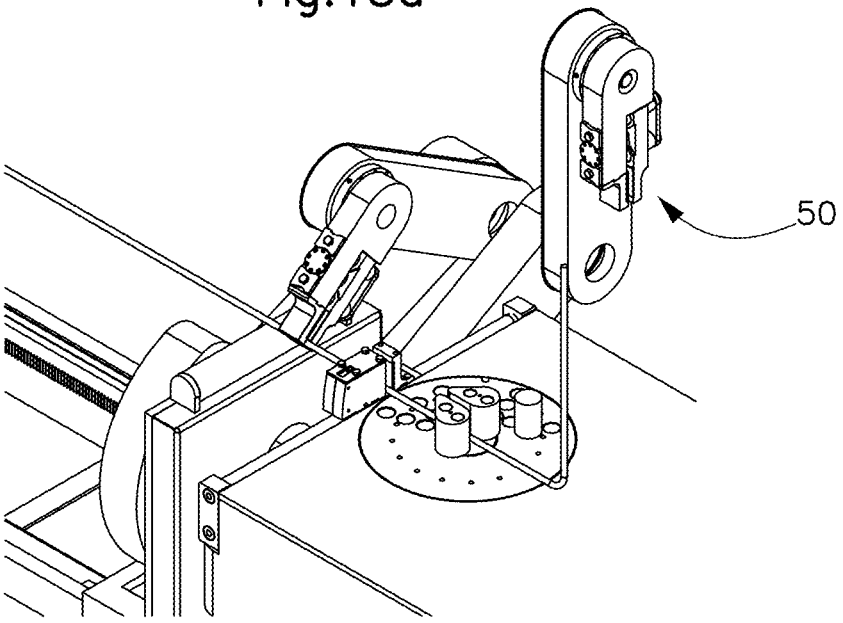
Figure 13C:
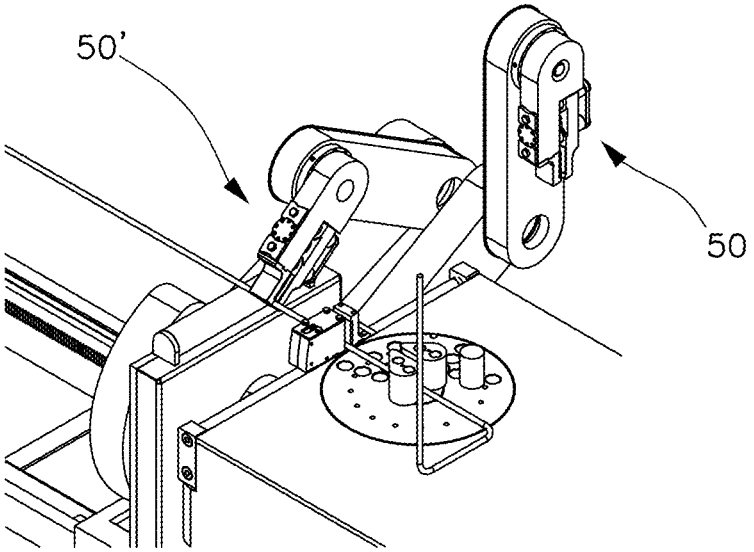
Figure 13D:
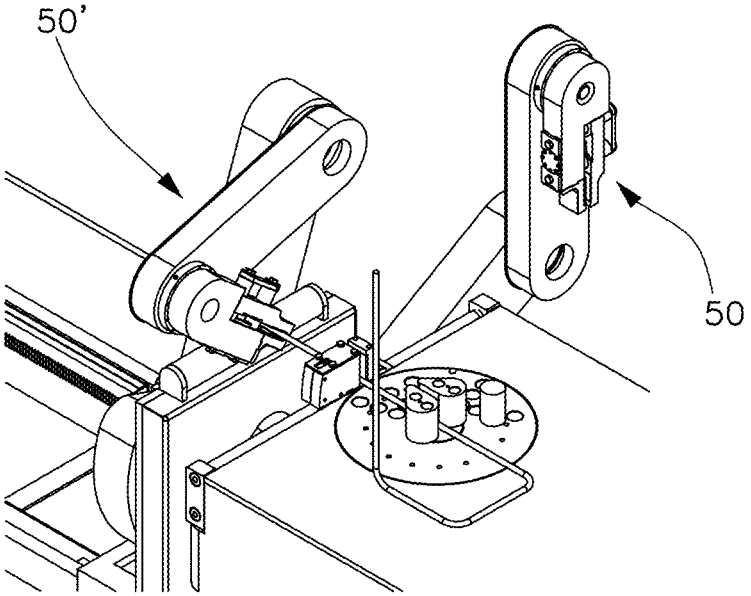
Figure 13E:
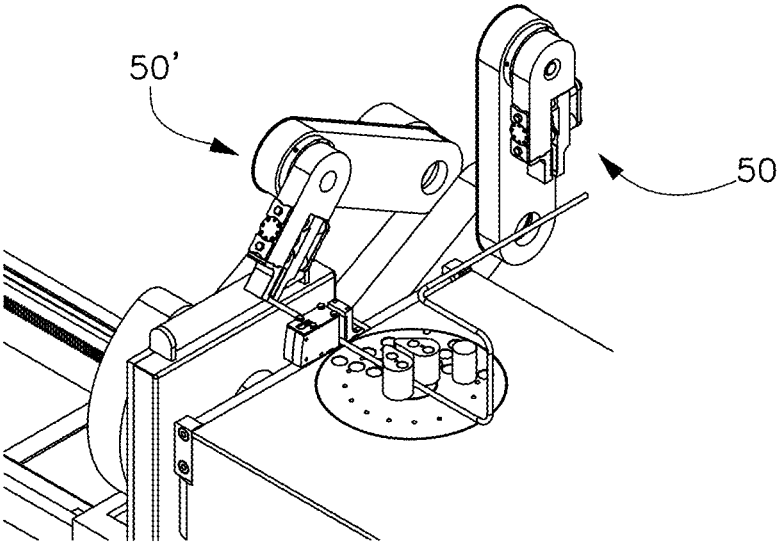
Figure 13F:
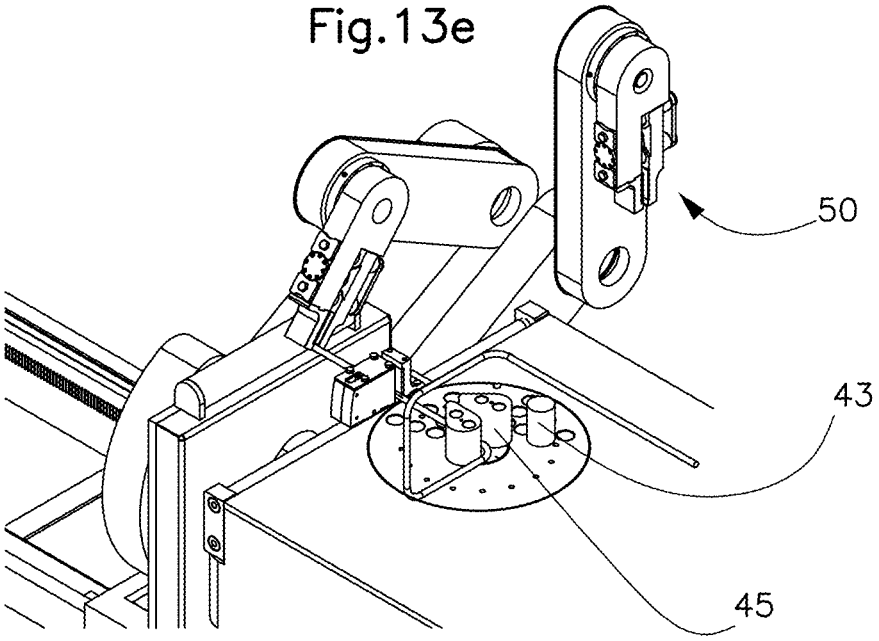

Advantageously, the apparatus 1 can comprise at least one further transfer device 50', dissociated from the bending units 41, for example intermediate, fixed or movable independently between the bending units 41 themselves, otherwise quite similar to each transfer device 50 (see FIG. 13*a*). The transfer devices 50, 50' can therefore be operative in cooperation along the whole longitudinal extension of the apparatus 1, thus allowing, in particular, the manipulation, the transfer and the unloading in sequence, on the unloading plane β at the unloading station 6, of shaped bars 2*a* of shorter length than the total length of the apparatus 1 (see FIG. 2).

Each transfer device 50, 50' preferably comprises an articulated arm 51 and at least one gripping member 52 carried to the opposite end of the articulated arm 51.

The articulated arm 51 is mounted below the work surface α, preferably articulated, in particular articulated or pivoted, at the base of the bending unit 41 below the work surface α.

More precisely, the articulated arm 51 preferably comprises at least a first member 51*a* and a second member 51*b*, mutually articulated at an intermediate articulation axis 53 (see FIG. 8*b*). The arm 51, preferably by means of the same first member 51*a*, is also articulated below the work plane α of the bending unit 41 at a constraint axis 54 (see FIG. 8*d*). Alternatively, the articulated arm 51 may comprise a greater number of articulated members, also provided with different, in particular further, degrees of freedom.

Figure 8D:
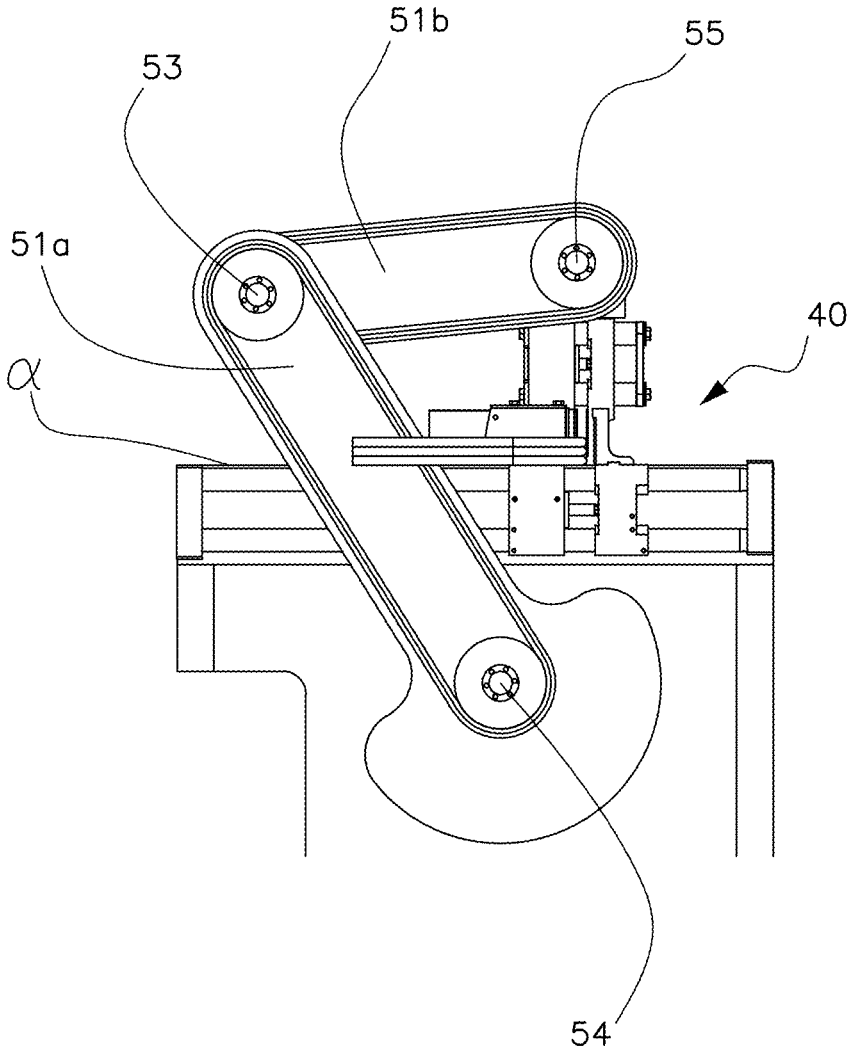
FIG. 8*d* shows a side view from a side opposite to that of FIGS. 8*a*-8*c*, of the apparatus according to the invention, in the operating step shown in FIG. 8*c;*
Figure 9A:
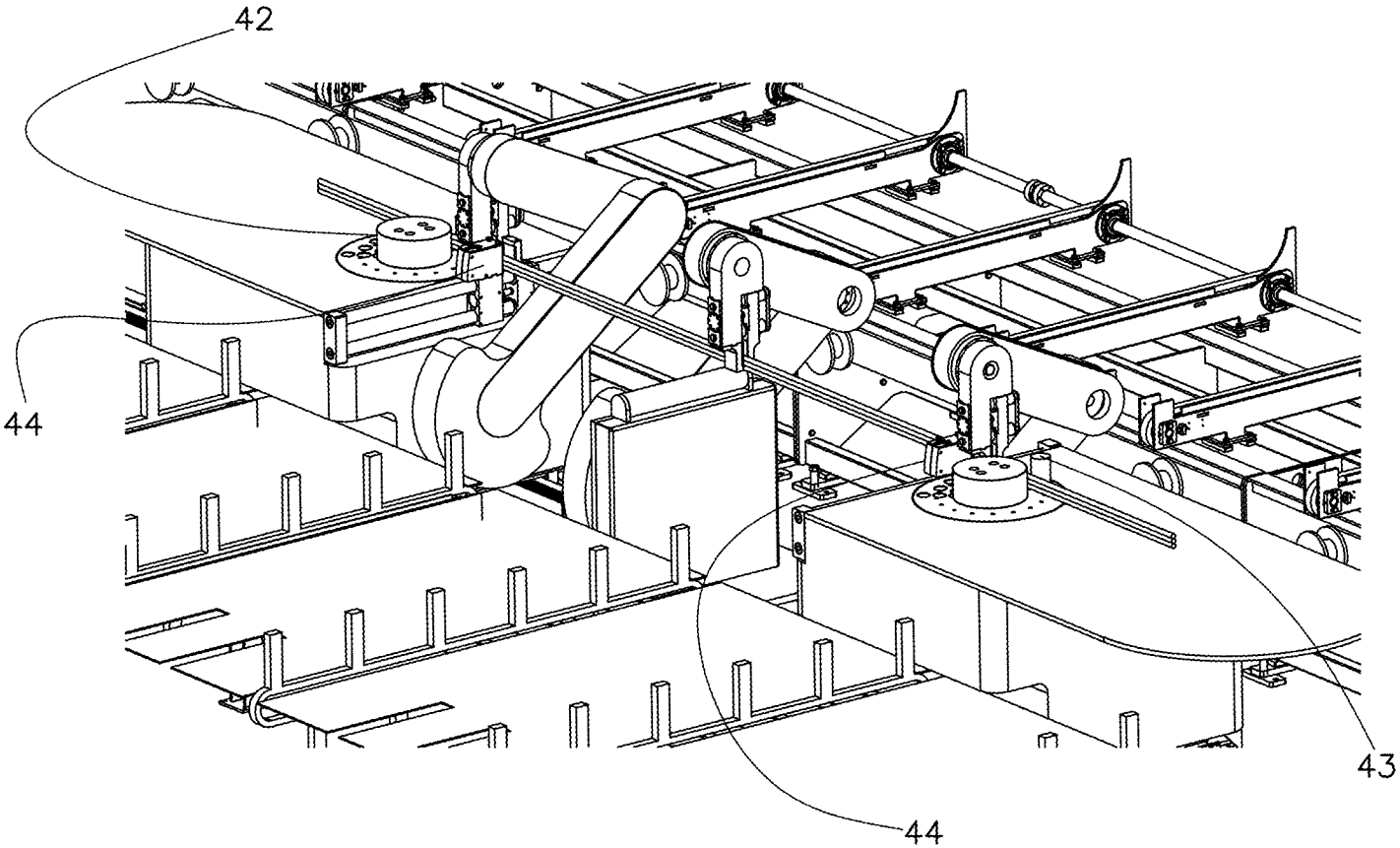
FIGS. 9*a*, 9*b*, 9*c*, 9*d*, 9*e*, 9*f*, 9*g* show a perspective view of the apparatus according to the invention in successive operating steps, for manufacturing rebars with clockwise and counterclockwise bends on the same bar.
Figure 9B:
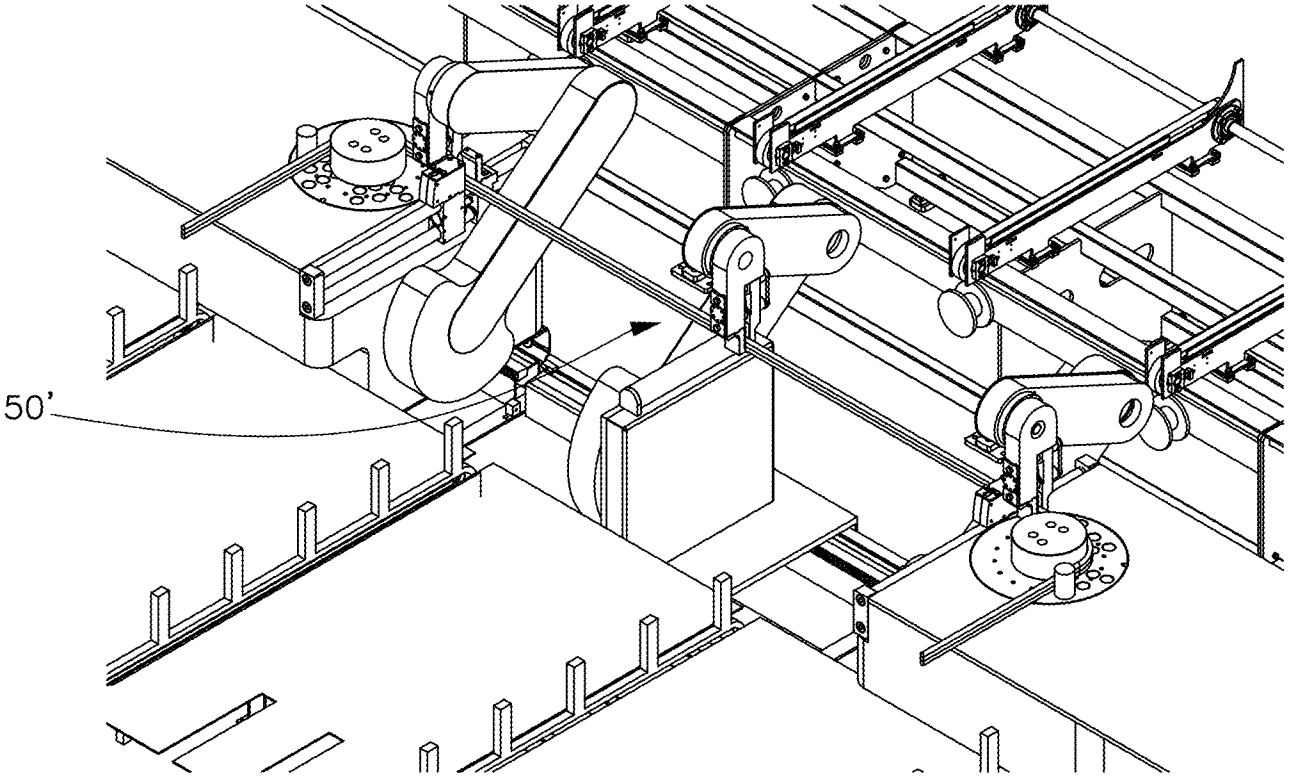
Figure 9C:
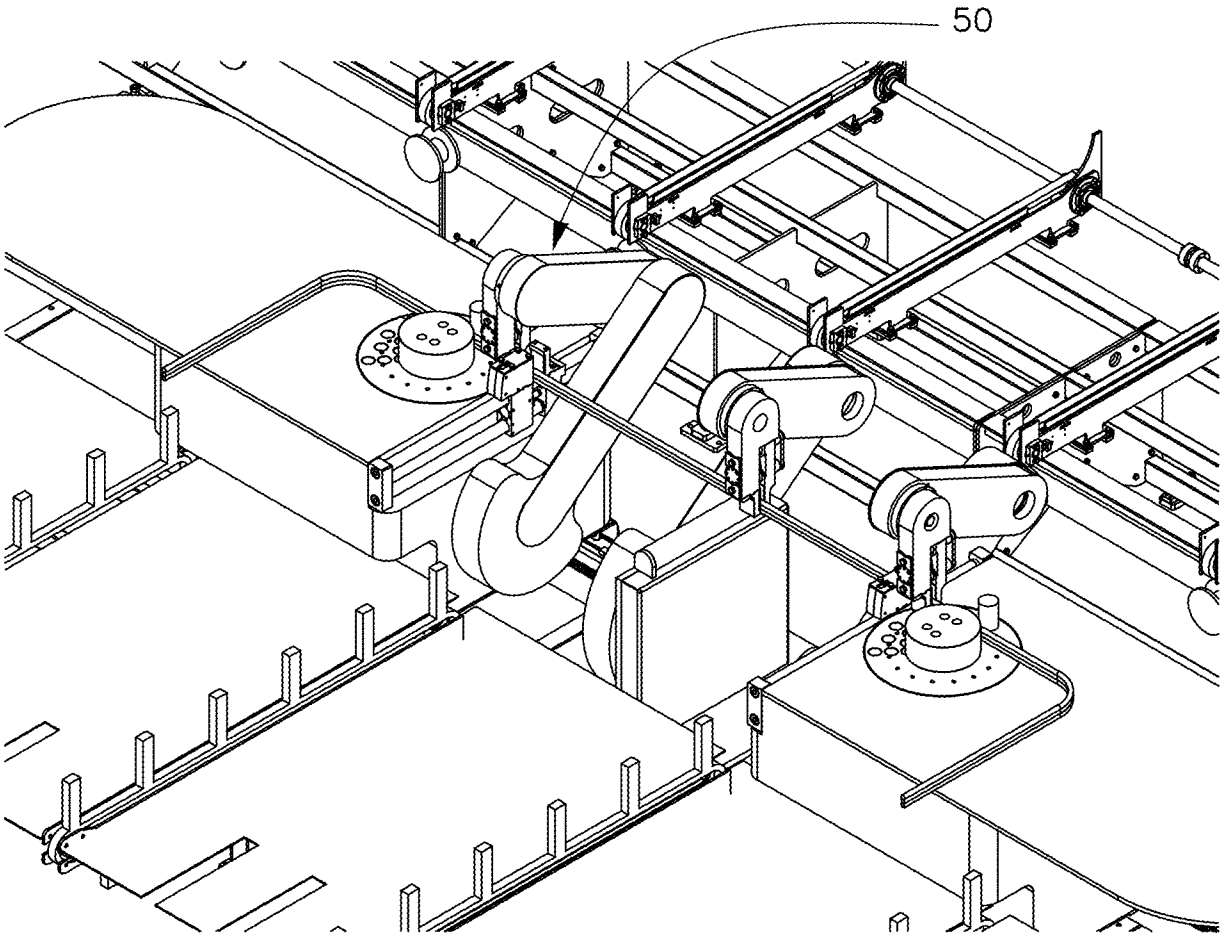
Figure 9D:
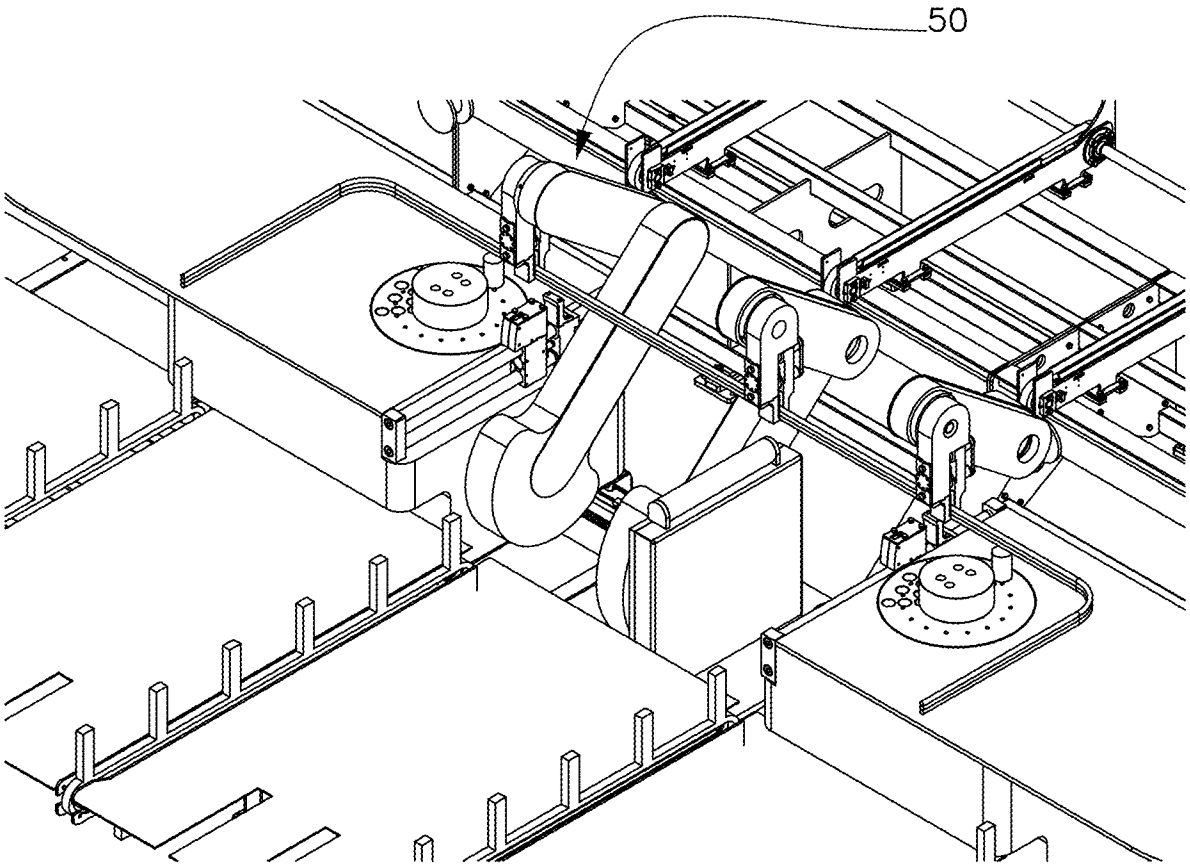
Figure 9E:
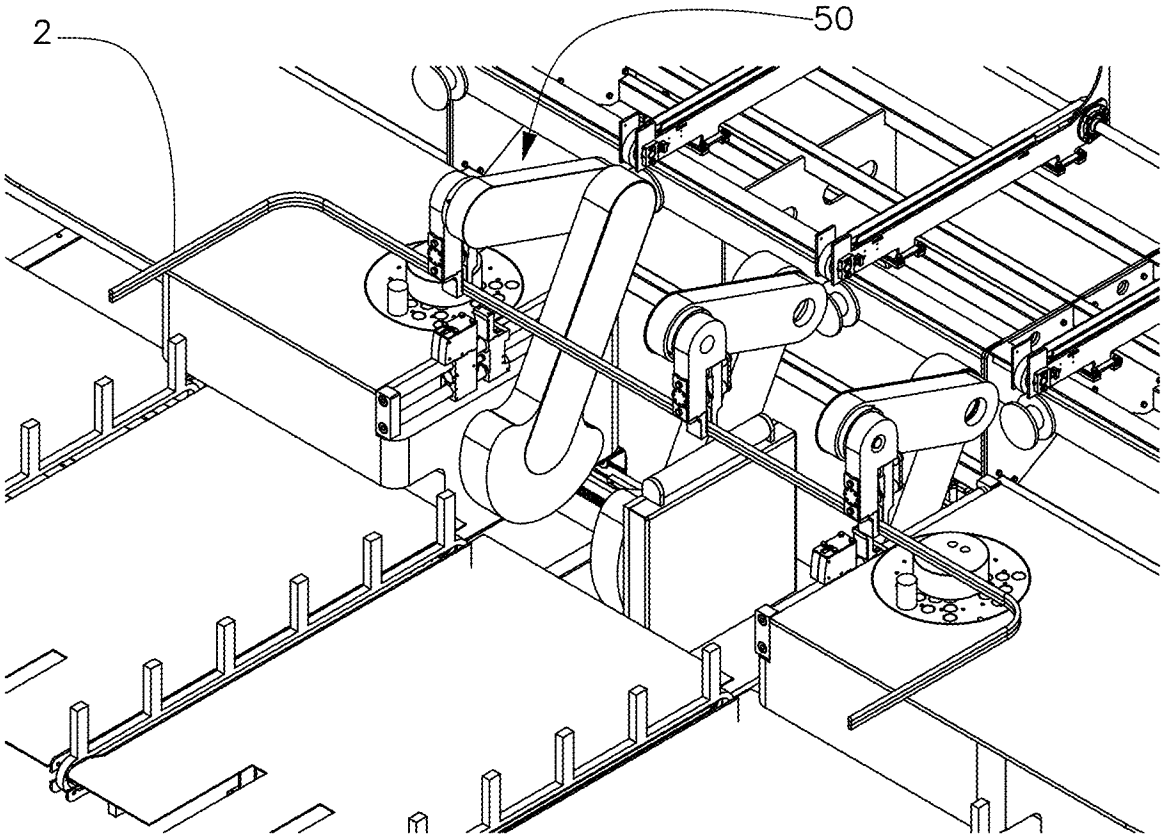
Figure 9F:
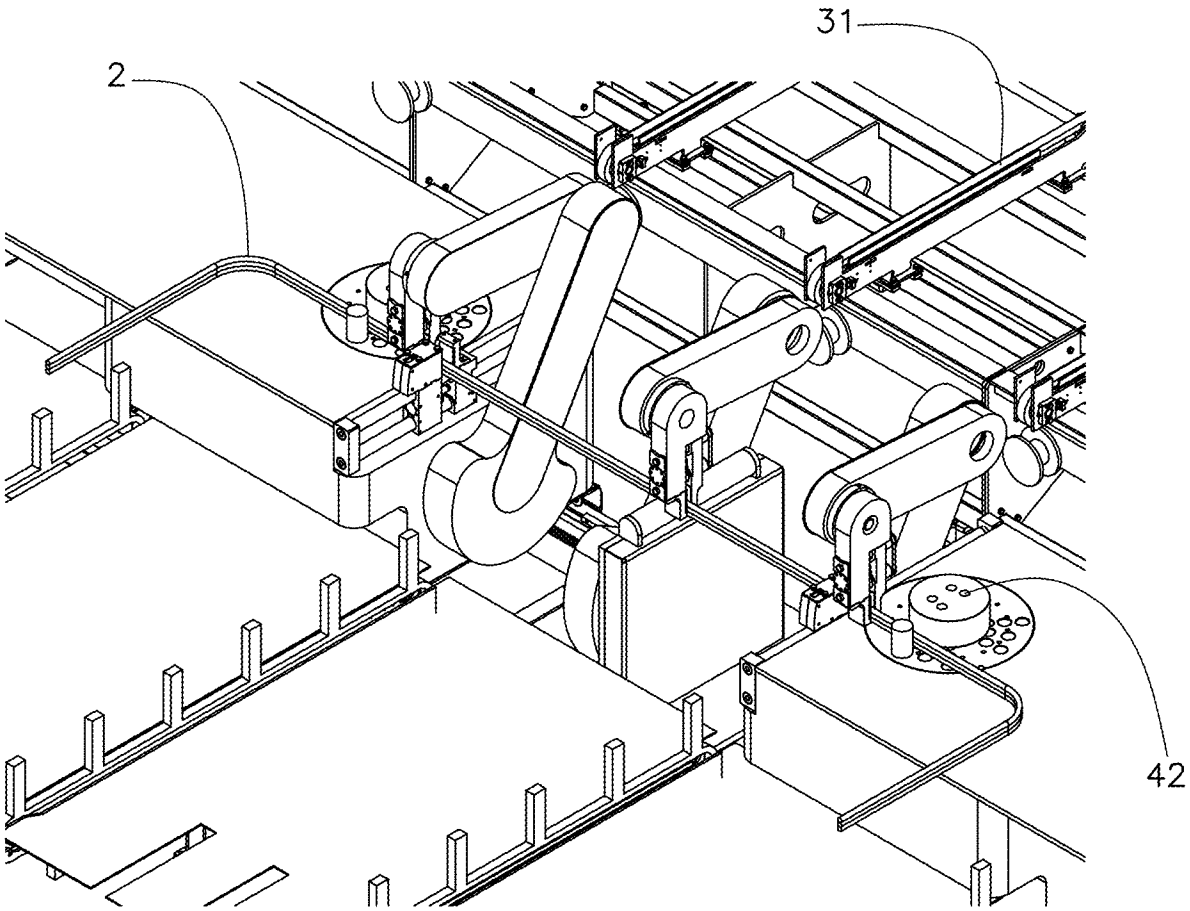
Figure 9G:
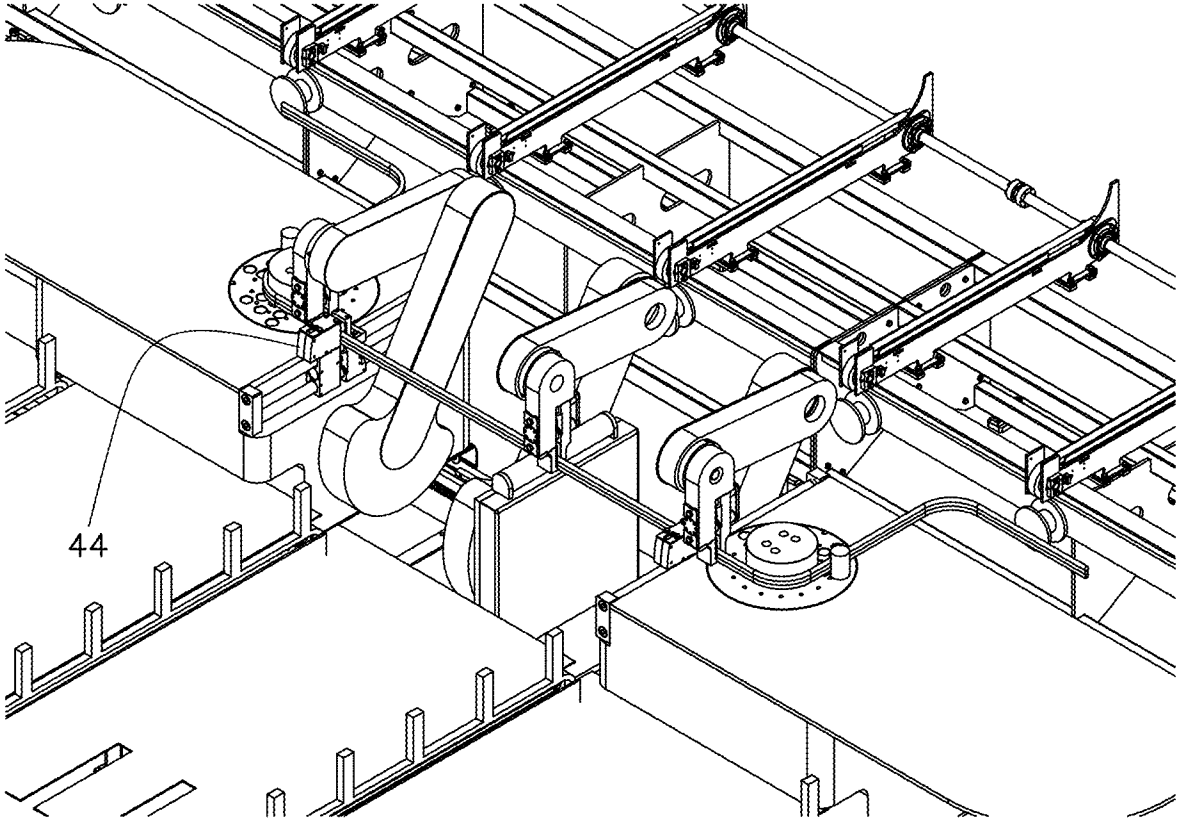

The articulated arm 51 is in turn articulated to the gripping member 52 at an orientation axis 55, in particular at the extremity (see FIG. 8*d*).

In particular, the intermediate axis 53, the constraint axis 54 and the orientation axis 55 are preferably parallel to the aforementioned longitudinal direction.

The transfer device 50 is movable, in particular oscillating, in a transfer motion, between a feeding position 3*b* at the feeding station 3 and an operative bending position, in particular for inserting the bars 2 into the insertion seat 46 of the bending head 40. In particular, at the feeding position 3*b* the bars 2 are arranged and aligned in a single layer (see FIG. 6).

The transfer device 50, 50' can be movably operated in the aforementioned transfer motion by means of a respective motor assembly.

Furthermore, the transfer device 50, 50' can be further moved by an unloading, preferably oscillating, motion between the aforementioned bending operating position and an unloading position in the unloading station 6, arranged to the side of the bending unit 4, opposite to the feeding station 3.

In practice, the transfer assembly 5, comprising at least one transfer device 50, preferably a pair of transfer devices 50 and possibly the further transfer device 50', is configured to transfer the number of bars 2 preferably between three stations, wherein the aforementioned transfer devices can be operated in a coordinated manner.

More precisely, the transfer assembly 5 preferably permits to transfer the number of bars 2 to be processed from the feeding station 3 to the bending unit 4, so that at least one bending step takes place there, as well as to transfer the number of bent bars 2*a* from the bending unit 4 to the unloading station 6.

The transfer assembly 5 then preferably allows a first transfer and a second transfer to be carried out, in an overall path between, respectively feeding 3 and unloading 6 stations, opposite each other with respect to the bending unit 4, arranged in an intermediate position between them. The bending unit 4, therefore, can be a crossing station in this sense.

In order to allow this crossing, the transfer assembly 5, which is preferably placed at the intermediate bending unit 4, advantageously permits to take up the number of bars 2 according to any orientation and to release the same number of bars 2 on a respective releasing, operating or unloading plane, in an ordered configuration, in particular in abutment and, in the case of a plurality of bars 2 or bent bars 2*a*, stacked, i.e. superimposed, one on the other. In particular, according to the described path, the number of bars 2 can be either released, for subsequent bending, or taken up at the insertion seat 46. To obtain this effect, the gripping member 52, of each transfer device 50, 50' involved, is oriented following an orientation motion, in particular with an overturning, indifferently in the first or second mentioned transfer, empty o when holding the number of bars 2, to release the bars 2.

In particular, the gripping member 52 may be overturned, following the aforementioned orientation motion, first on one side and then on the opposite side with respect to the articulated arm 51 to which it is articulated, as described in detail below.

Among the consequences of this circumstance, in particular, the number of bars 2, 2*a* can for example cross the bending unit 4 and be released with an open motion of the gripping member 52.

Furthermore, the gripping member 52 can be oriented, following the aforementioned overturning, with a respective passage opening 7 facing downwards in use, in particular towards the releasing plane. In other words, thanks to the aforementioned overturning, the gripping member 52 can be overhanging, in the overturned configuration, with respect to the passage opening 7.

This circumstance permits, for example, to accompany the number of bars 2, 2*a* on the unloading plane β into the unloading station 6, in abutment thereon, and to separate from this same unloading plane β, with a lifting motion of the gripping member 52.

More precisely, the articulated arm 51 is preferably shaped so as to overturn the gripping member 52, by means of corresponding rotations around the aforementioned joints, for example around the intermediate axis 53 and the orientation axis 55. Consequently, for example, a number of bars 2 may be taken up from the feeding position 3*b*, (see FIG. 6) and transferred to the bending position (see FIGS. 8*a*, 8*b* and 8*c*), crossing the articulated arm 51.

Thanks to the aforementioned overturning, in particular, the transfer device 50 is able to release the number of bars 2 from above, inserting them into the insertion seat 46.

The articulated arm 51 is also preferably capable of taking up and transferring the bars 2 in the aforementioned path, between the bending position and the unloading position, in particular without making any shifting of the number of bars 2 engaged, avoiding unwanted misalignments, especially if the bars are already bent. The articulated arm 51, in particular, carries the gripping member 52 in a first configuration at the feeding position 3*b*, while it can bear the gripping member 52 overturned in the bending position. It is possible to provide such overturning, alternatively, in the second transfer, between the bending position and the unloading station 6.

In particular, the kinematics of the articulated arm 51 is preferably configured in such a way that the member articulated to the gripping member 52 can oscillate above the bending head 40, in particular, with a roto-translation motion (see in particular the FIGS. 8*a*-8*d*). Thanks to the particular conformation of the articulated arm 51, the transfer device 50, 50' can therefore transfer the bars 2, so that they can overcome, by crossing it from above, the encumbrance of the articulated arm 51, constrained under the work surface α.

Likewise, the transfer device 50 can unload the bent bars 2*a*, without altering their orientation and ordered arrangement. In fact, thanks to the particular kinematics of the articulated arm 51 which carries the gripping member 52, the bent bars 2*a* are accompanied to the unloading station 6 and released from above, bringing the gripping member 52 into an open configuration. This circumstance makes it possible, in particular, to orderly sort into piles, that is to orderly superimpose the bent bars 2*a*.

Release "from above" means that the passage opening 7 of the gripping member 52 is facing downwards in the release condition.

Furthermore, it should be pointed out that the particular kinematics of the articulated arm 51 allows the transfer device 50 to cooperate with the bending units 41 in the steps of bending the bars 2, orienting and rotating in a suitable way the number of bars 2, 2*a* retained, as described in detail below.

The kinematic configuration of the solution described for the transfer device 50, 50' is to be considered as preferred, but not limiting. In particular, it is possible to provide that the articulated arm 51 includes a different number of members and that the constraints between them can be different, thus giving rise to different relative motions, rotational and/or translational, according to axes oriented in a different way.

Figure 6:
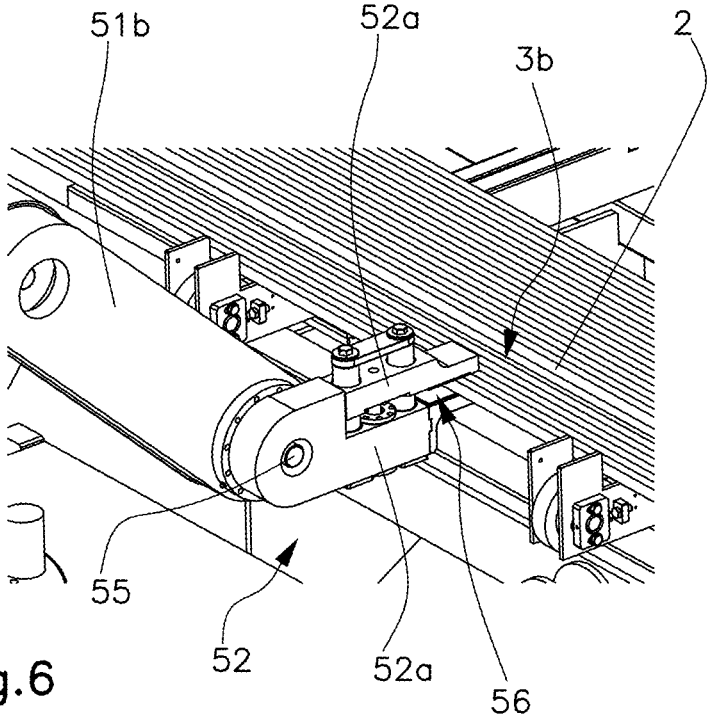
FIG. 6 shows a perspective view of a detail of the invention in a further operating step.

The gripping member 52 is preferably of the jaw type (see for example FIG. 6).

Figure 7:
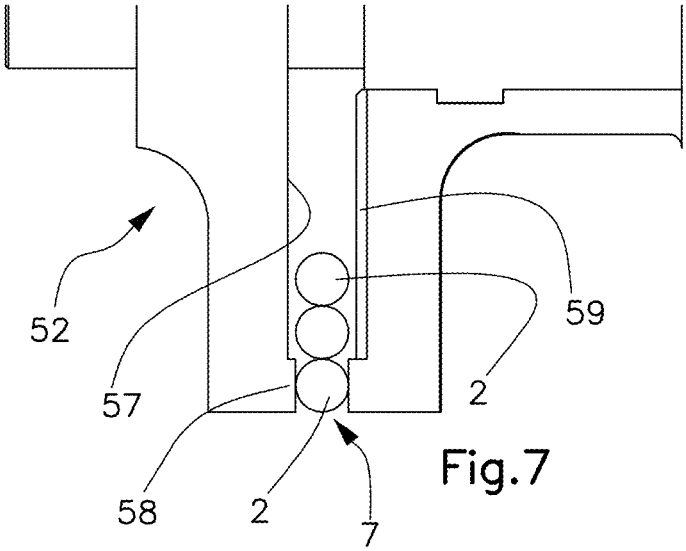
FIG. 7 shows an enlarged side view of a detail of the apparatus according to the invention.

It preferably comprises a pair of jaws 52*a* of which at least one is movable relative to the other in a closing and opening motion, between an open configuration and a closed configuration. More precisely, in the open configuration, the jaws 52*a* are set apart from each other to release the bars 2, 2*a* or to insert them, through the passage opening 7, while in the closed configuration the jaws 52*a* are mutually approached, to enclose and intercept a number of bars 2, 2*a* (see FIG. 7).

In particular, the jaws 52*a* are shaped so as to define between them a receiving space 56, which in the closed configuration is closed, permitting to retain, in particular clench, the aforementioned number of bars 2, 2*a*, while in the open configuration is open through the passage opening 7.

In particular, at least one jaw 52*a* can shape internally a respective recess 57 and an inwardly projecting end portion 58.

The recess 57, in particular, can have at least partially a flat wall, intended to face parallel to a respective flat wall of the opposite recess 57, so that the bars 2, 2*a* retained in the receiving space 56 in the closed configuration are arranged side by side on the same floor.

A layer 59 of elastic material, for example rubber, may be applied on the flat wall of at least one recess 57 to maintain the positioning of the bars 2, 2*a* during the overturning and transfer of the bars 2, 2*a* as described in detail below.

Furthermore, the at least one protrusion 58 can cooperate with the at least one recess 57 to hold the intercepted bars 2. Advantageously, however, the at least one protrusion 58 is configured to preferably clamp only the end bar 2, 2*a*, between the intercepted ones, while the remaining bars 2, 2*a* are held in an orderly manner inside the receiving space 56 (see FIG. 7).

The unloading station 6 can be defined in the space, in particular on the ground, next to the bending unit 4, to receive the bent bars 2*a*, already subjected to a bending cycle by the at least one bending unit 41 (see FIG. 1).

The space on the ground may be further equipped with containment devices 60, preferably movable, for example made of racks, conveyor belts, trolleys or catenary means, to allow the unloading station 6 to be easily freed (see for example FIG. 2).

The operation of the apparatus according to the invention is understandable from the above description.

Single bars or, preferably, bundles of bars 2 to be bent are fed into the feeding station 3 on the feeding plane 3*a*.

The transversal positioning devices 31, with a series of alternating movements, move the bundle of bars 2 fed on the feeding plane 3*a*. Finally, the bars 2 are arranged in an orderly alignment in a single layer on the feed plane 3*a*.

Figure 3:
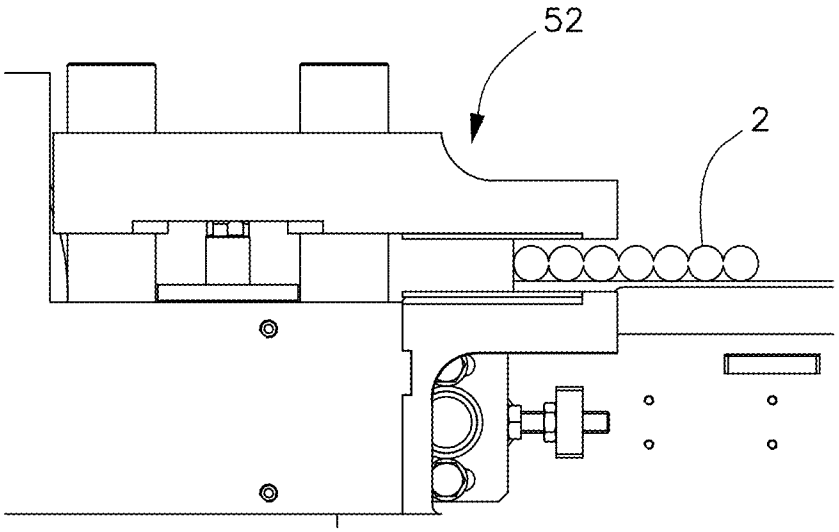
FIG. 3 shows an enlarged side view of a detail of the apparatus in an operating step.

The gripping member 52, preferably of at least one pair of transfer devices 50, 50', is then moved closer to a predefined transverse distance to the feeding station 3 and brought into the open configuration, so as to intercept a predetermined number of bars 2. This predefined transverse distance substantially corresponds to the transverse dimension of the number of bars 2 to be taken up. In particular, if the bars 2 are placed side by side due to the action previously performed by the transversal positioning devices 31, the number of intercepted bars 2 is perfectly equal to that expected (see FIG. 3).

The gripping member 52 is then operated in the closed configuration to clench the number of bars 2 to be subjected to the bending cycle.

Subsequently, the transfer devices 50, 50' are operated in a coordinated manner in the transfer motion from the feeding position 3*b* to the bending position, while moving the gripping device in the orientation motion. Preferably the gripping member 52 is overturned at the same time and, consequently, the bars 2 are correctly intercepted. The orientation motion, in particular of overturning, of the gripping member 52 can be carried out, alternatively, in the subsequent transfer, from the bending position to the unloading station 6 or empty, in the absence of retained bars 2.

The at least one bending unit 41 then performs a bending cycle, advantageously with the cooperation of the transfer devices 50, 50' to obtain bent bars 2*a*.

For example, the bending unit 41 can make a succession of bends in alternately opposite directions, simply thanks to the intervention of the transfer assembly 5. In particular, after the execution of a first bend (see FIGS. 9*a* and 9*b*) the transfer assembly 5 can take up the bent bars, lift them from the insertion seat 46 (see FIGS. 9*c* and 9*d*), wait for the bending head 40 to reverse the position of the bending pin 43 (see FIG. 9*e*) and reinsert the bars, from the side opposite to the central spindle 42, in the insertion seat 46 suitably positioned (see FIG. 9*f*), to carry out a bending in the opposite direction to the previous one (see FIG. 9*g*), around the spindle 42.

Figure 10A:
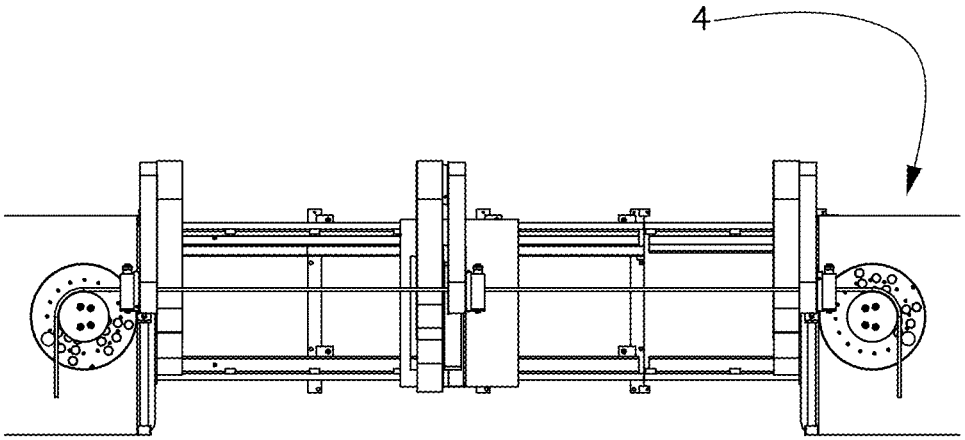
FIGS. 10*a*, 10*b*, 10*c* respectively show a plan view of the apparatus according to the invention, in successive steps of manufacturing a bar with clockwise and counterclockwise bends, according to a method alternative to that shown in FIGS. 9*a*-9*g;*
Figure 10B:
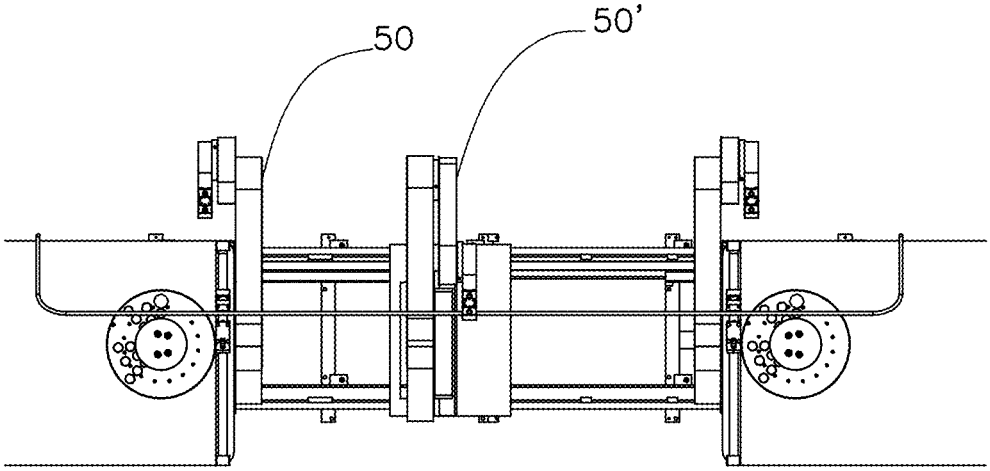
Figure 10C:
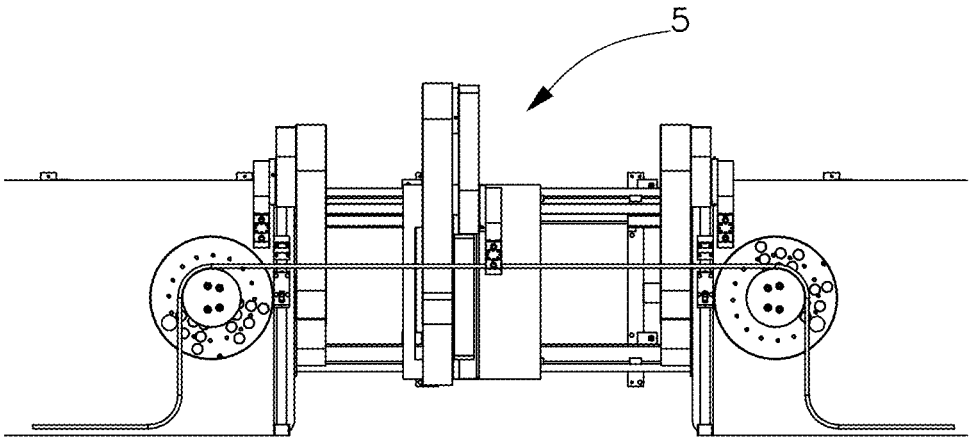
Figure 10D:
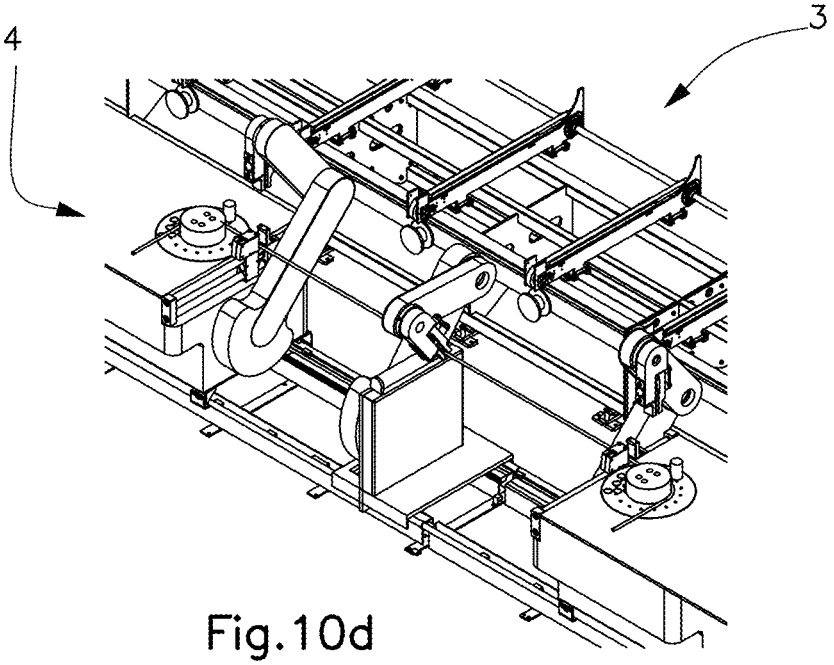
FIGS. 10*d* and 10*e* respectively show a perspective view of the same apparatus in steps 10*a* and 10*b;*
Figure 10E:
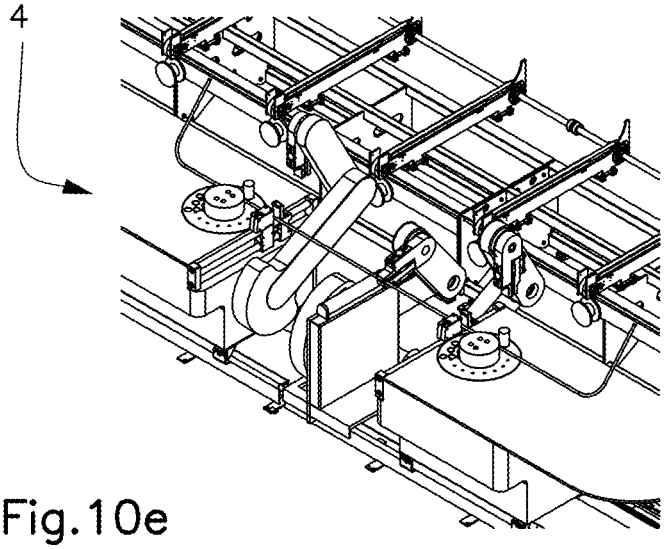

Alternatively, if the bar 2 to be bent is only one, the at least one bending unit 41 can carry out a cycle of bending in succession in alternately opposite directions, at the ends of the bars 2, cooperating in a different way with the transfer assembly 5. In particular, after carrying out a first bend (see FIGS. 10*a* and 10*d*) and positioning relative to the bending unit 41 in the longitudinal direction (see FIG. 10*b*), the transfer assembly 5 can clamp respective portions of the bars 2 being processed, by rotating them by an appropriate angle, in particular by 180°, so as to correspondingly overturn the respective end portions (see FIGS. 10*b* and 10*e*). At this point, the bending head 40 can perform the subsequent bending in the opposite direction to the previous one (see FIG. 10*c*).

Furthermore, a pair of bending units 41 can perform bends having different radius of curvature on the opposite ends of the bars.

Figure 11A:
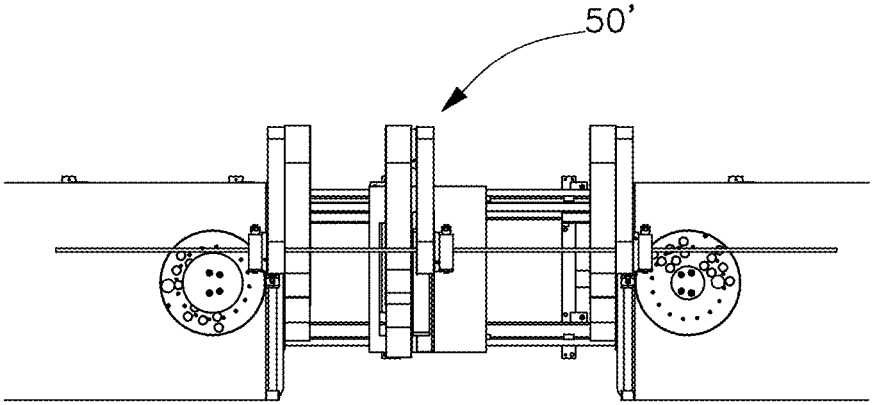
FIGS. 11*a*, 11*b*, 11*c* respectively show a plan view of the apparatus in successive steps of manufacturing a bar with bends of different radius of curvature at the respective ends.
Figure 11B:
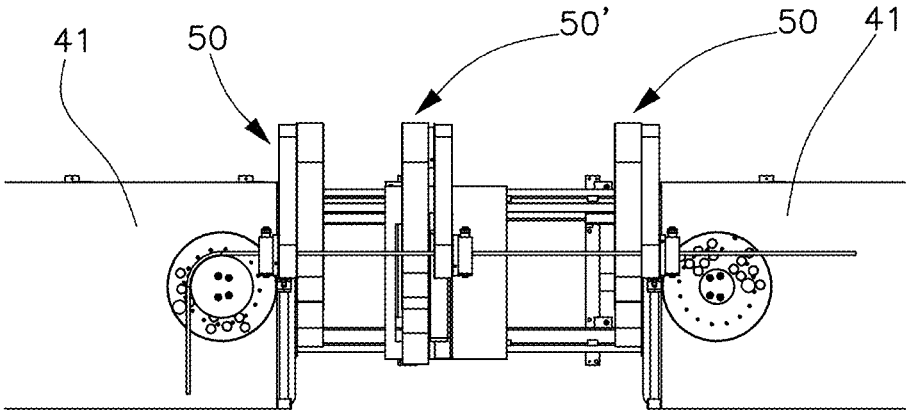
Figure 11C:
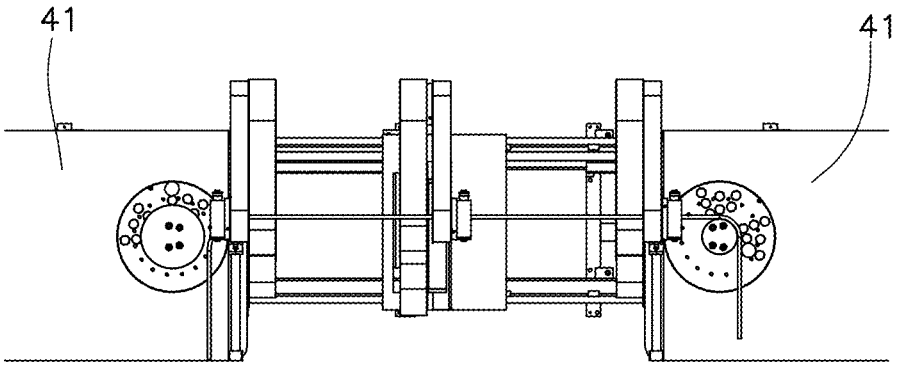

According to a first operating mode, it is possible to provide for installing respective differentiated bending heads 40 on the bending units 41, in particular differentiated spindles 42 (see FIG. 11*a*). The bending is then performed on one end of the bars 2, by operating the respective bending head 40 and possibly holding the bars by means of the gripping member 52 of the transfer devices 50 (see FIG. 11*b*). Thanks to the same devices 50, the bars 2 are then disconnected from the bending unit 40 just used, suitably positioned along the transverse direction, and finally inserted at the insertion seat of the opposite bending unit 40 (see FIG. 11*c*).

Figure 12A:
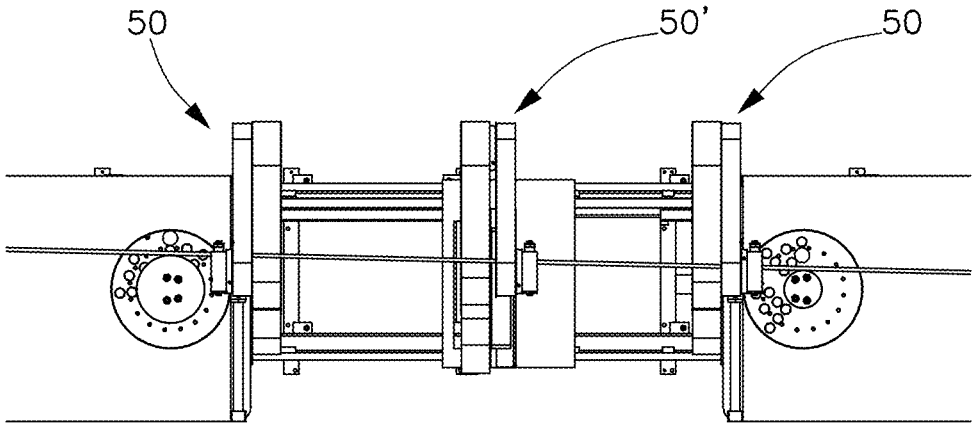
FIGS. 12*a*, 12*b* respectively show a plan view of the same apparatus in successive operating steps of manufacturing a bar with bends of different radius of curvature at the ends, according to an operating mode different than that shown in FIGS. 11*a*-11*c;*
Figure 12B:
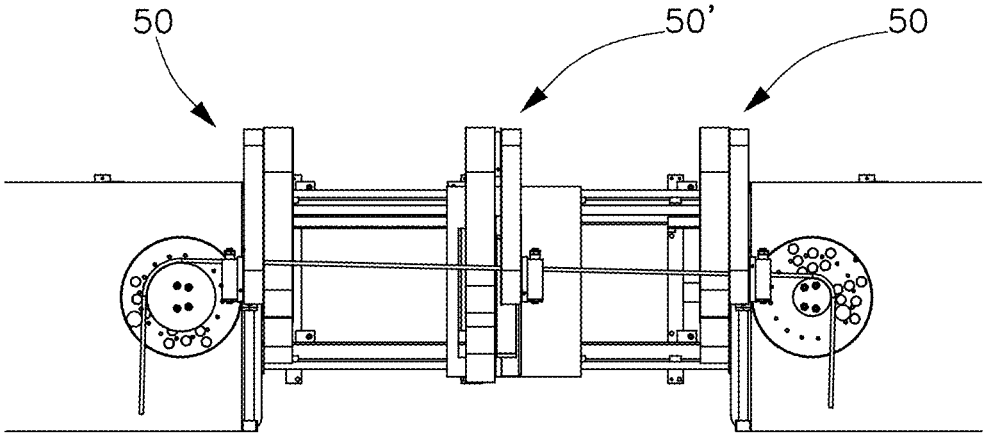

Alternatively, it is possible to achieve the same result, by making the end bends with differentiated radius of curvature, holding the bars 2 by means of the gripping members 52, so that they are positioned tangent to both spindles 42 (see FIG. 12*a*). In this circumstance, the bars 2 will be inclined, on the work plane α, with respect to the longitudinal direction. At this point, in a single step, it is possible to carry out the bending of the ends of the bars 2 (see FIG. 12*b*).

Furthermore, it is possible to make three-dimensional pieces, for example by using a bending head 40 equipped with shapes 45. This result is achieved by making a first bend (see FIG. 13*a*), then rotating, thanks to the gripping member 52 and the particular articulation to the articulated arm 51, the bars 2 themselves around the respective longitudinal axis, by an appropriate angle (see FIG. 13*b*), and then perform a subsequent bend (see FIGS. 13*c*-13*f*).

Figure 14A:
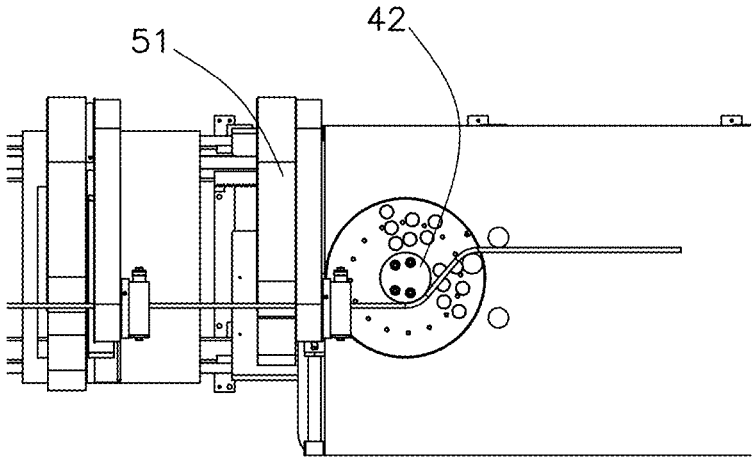
Figure 14B:
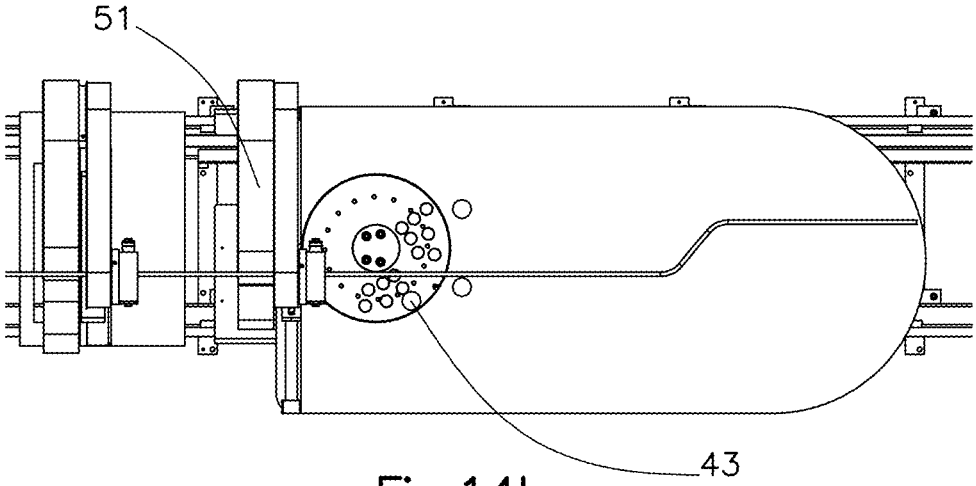
Figure 15A:
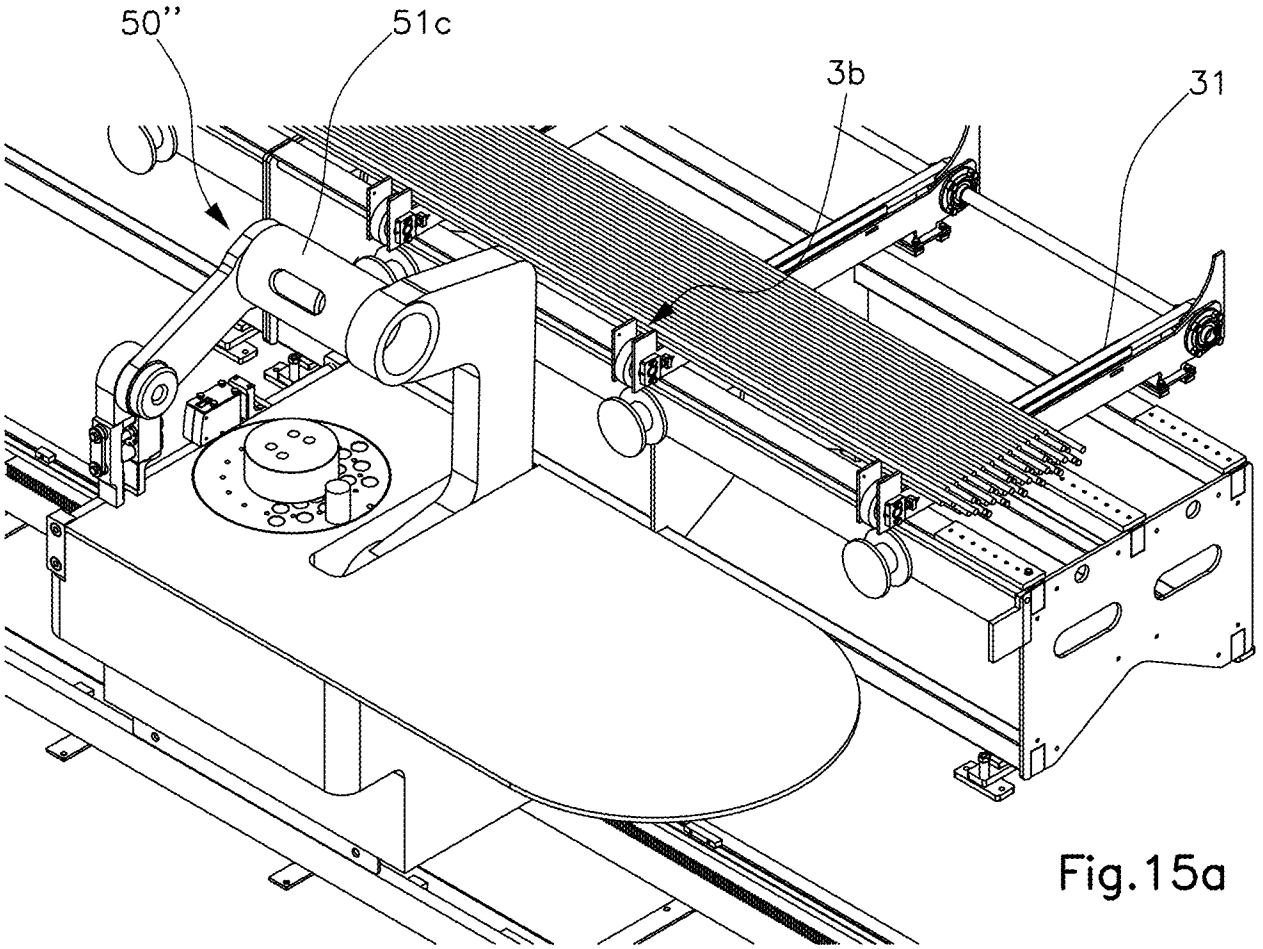
FIG. 15*a* shows a perspective view of the transfer assembly of the apparatus according to a different embodiment.
Figure 15B:
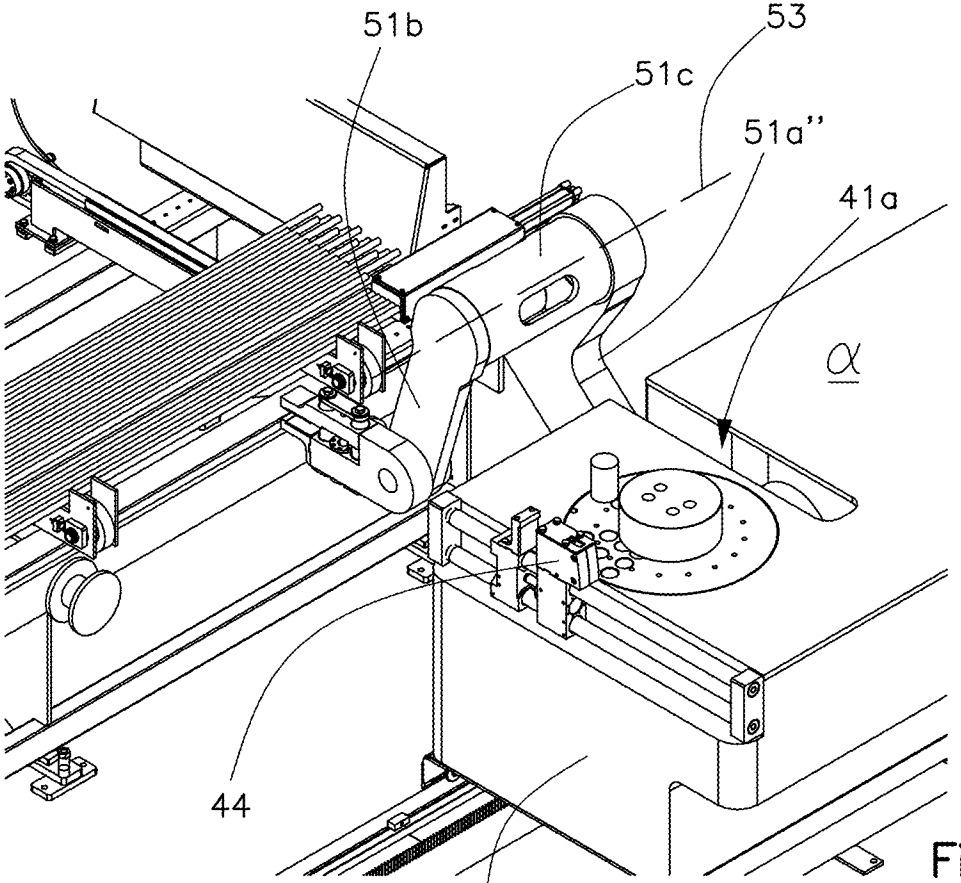
FIGS. 15*b* and 15*c* respectively show a perspective view and an enlarged view of a detail of the same transfer assembly, in an operating step of taking up the bars.
Figure 15C:
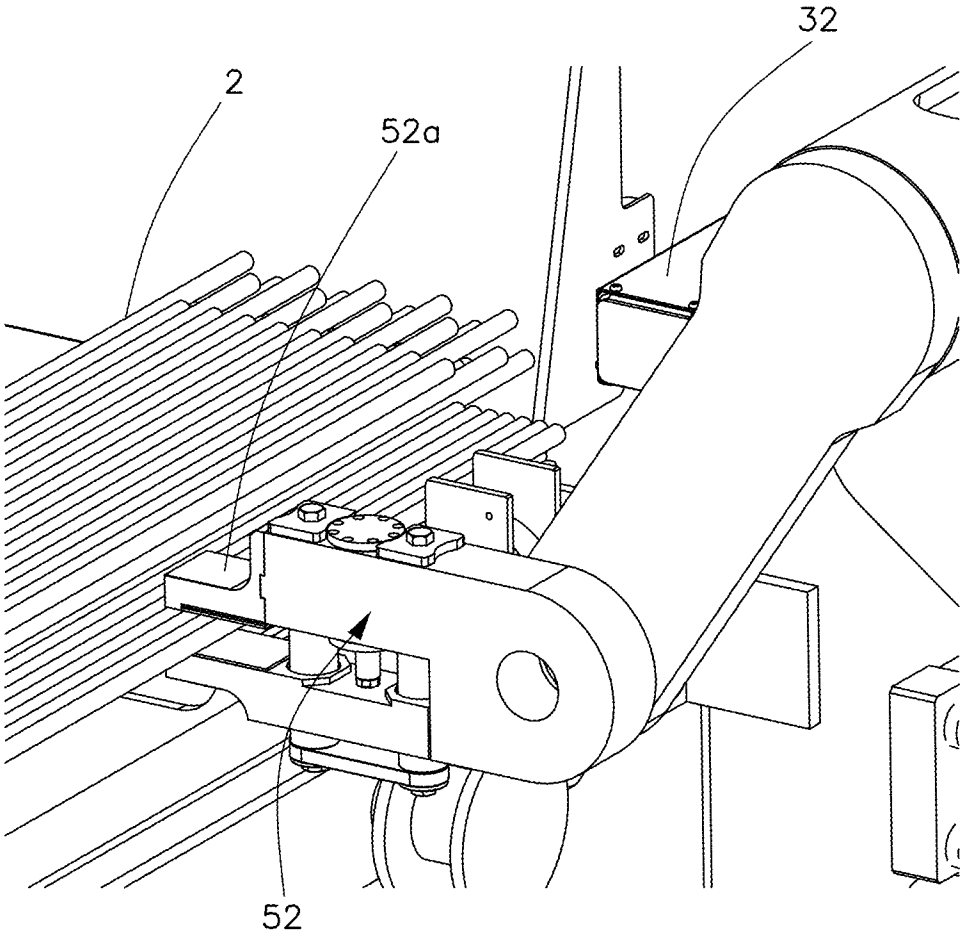
Figure 15D:
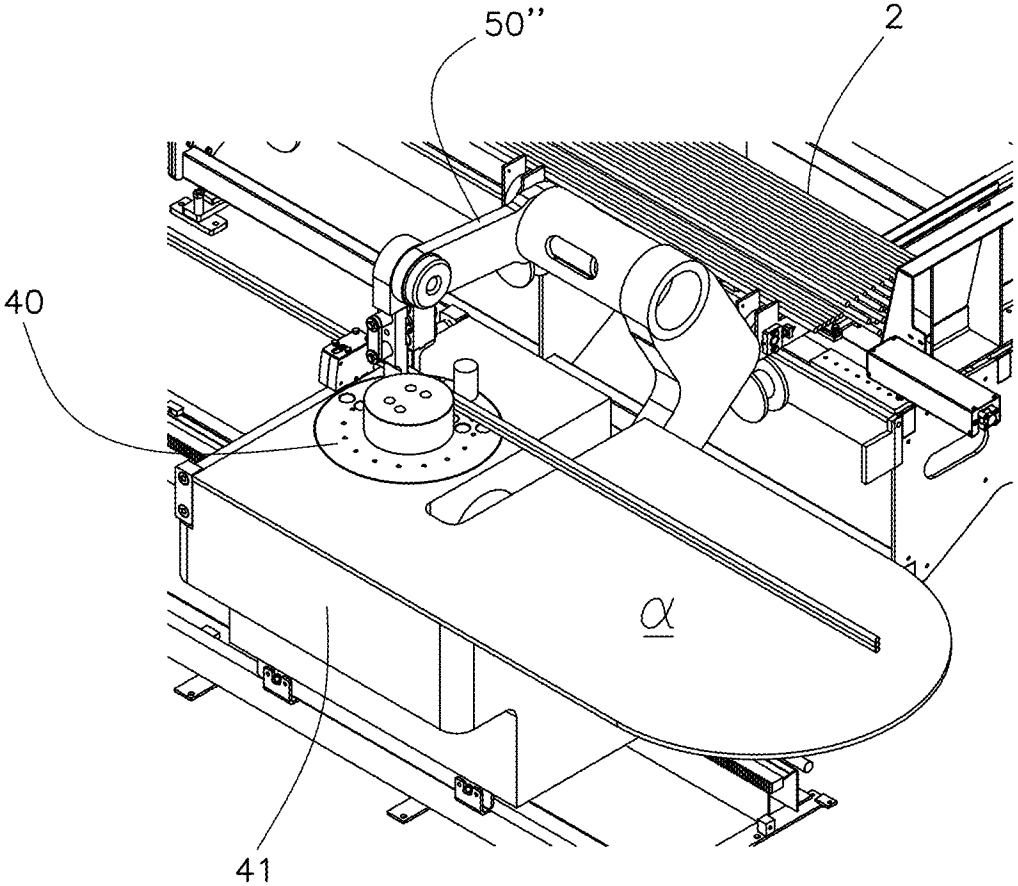
FIG. 15*d* shows a perspective view of the transfer assembly in a step of inserting the bars in a bending head of the apparatus.
Figure 15E:
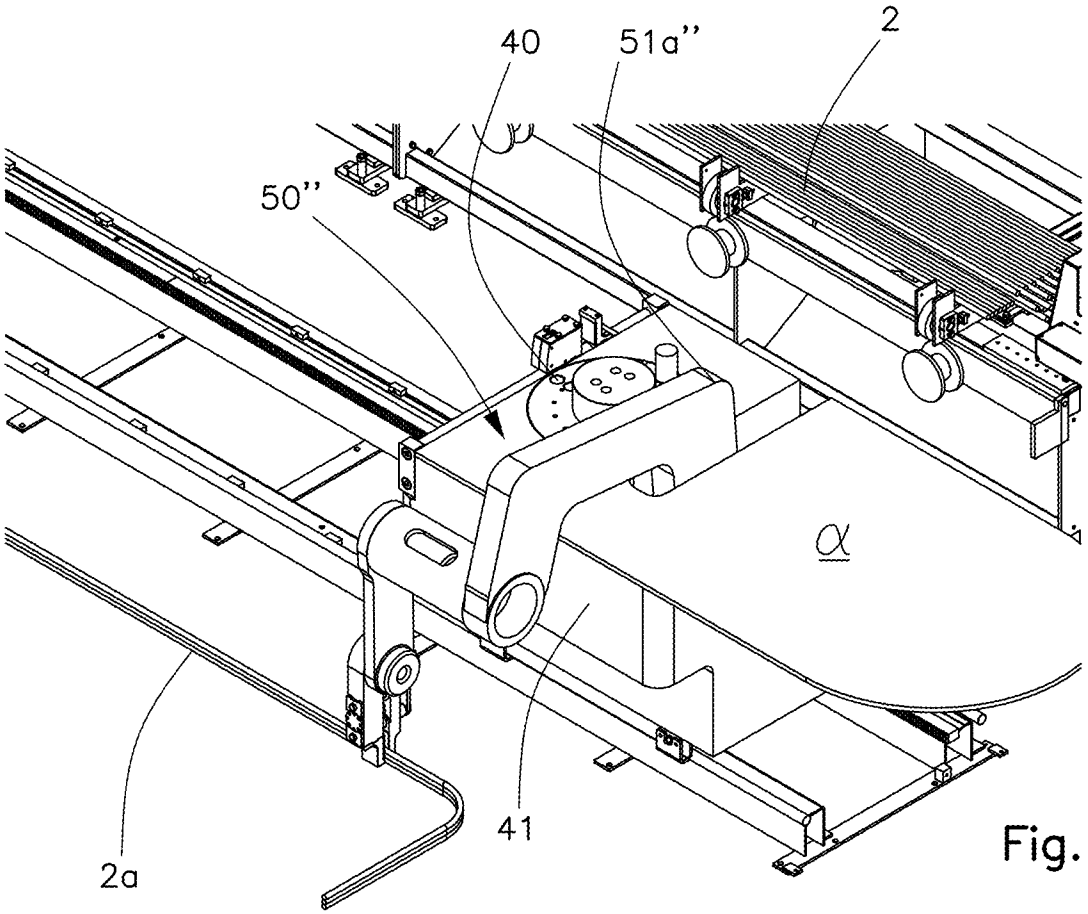
FIG. 15*e* shows a perspective view of the transfer assembly shown in FIGS. 15*a*-15*e* in an operating step of unloading the bars.

Finally, it is possible to easily produce bent bars 2*a* so-called "truss-bars", thanks to the cooperation of the transfer assembly 5 and to the provision of suitable opposing members to the eccentric bending pin 43 positioned on the work surface α (see FIGS. 14*a* 14*d*).

The transfer unit 5 is finally activated in the unloading motion to transfer in an orderly manner the bent bars 2*a* from the bending position to the unloading position in the unloading station 6.

According to a further embodiment shown in FIGS. 15*a*-15*e* it is possible to provide that the transfer device 50" is constrained under the work surface α, externally to the bending head 40 of the bending unit 41. The external side is intended as the side of the bending head 40 opposed to that in which the number of bars 2 is held during the bending step, for example by means of the abutment 44. In other words, the external side is the side in which, with respect to the spindle 42 or the double spindle 45, the eccentric pin 43 of the bending head 40 operates.

The transfer device 50" is preferably integrated with the bending unit 41 and, in particular, internally constrained to the base thereof.

In particular, the articulated arm 51 can be advantageously constrained, in particular pivoted, to the base of the bending unit 41, inside a recess 41*a* that extends through the base to the work surface α. The recess 41*a*, in particular, can allow the oscillation of the first member 51*a*" in the different handling steps described above.

This embodiment, for the rest quite similar to that described above, frees up the space on the inner side and, in the case of a pair of bending units 41, between the bending units 41, thus allowing to reduce the minimum distance at which the bending units 41 themselves can be positioned. In this way the apparatus 1 is able to produce very short rebar pieces.

To allow the operations of taking up, inserting and unloading the bars 2, 2*a*, the articulated arm 51 of the transfer device 50" can in this case comprise at least one spacer member 51*c*, for example interposed between the first member 51*a*" and the second member 51*b*. In particular, the spacer member 51*c* can extend in this case along the intermediate axis 53, to bring the gripping member 51 closer to the inner side of the bending unit 41, so as to operate at this area, to handle the bars 2, 2*a* (see for example FIGS. 15*a* and 15*c*). Alternatively, the spacer 51*c* can be interposed between the second member 51*b* and the gripping device 52, extending for example along the orientation axis 55. According to a further variant, different spacers can be interposed, extending respectively along the intermediate axis 53 and along the orientation axis 55, respectively.

Finally, the first member 51*a*" can be shaped so as to avoid interfering in particular with the work surface α during the transferring and/or unloading steps of the bars 2 or of the bent bars 2*a*. For this purpose, for example, the first member 51*a*" can advantageously extend with a double crank conformation, for example C-like (see FIG. 15*e*).

According to a third embodiment shown in FIGS. 16, 17*a*, 17*b* and 17*c* it is possible to provide that the transfer device 500 is constrained under the work plane α by means of a respective kinematic torque, but which, unlike the forms of embodiment described above, is split, thus bearing a pair of gripping members.

More precisely, the transfer device 500 comprises in addition to the gripping member 52, operating for example from the internal side of the bending head 40, a further gripping member 520, operating from the opposite side with respect to the same bending head 40.

In practice, starting from the common first member 51*a*, the spacers 51*c* and 510*c* are developed, starting from the intermediate axis 53, respectively from opposite sides to each carry the second member 51*b* and 510*b* respectively. Each of the latter is in turn articulated to the gripping member 52, 520 (see FIG. 17*a*).

Figure 16:
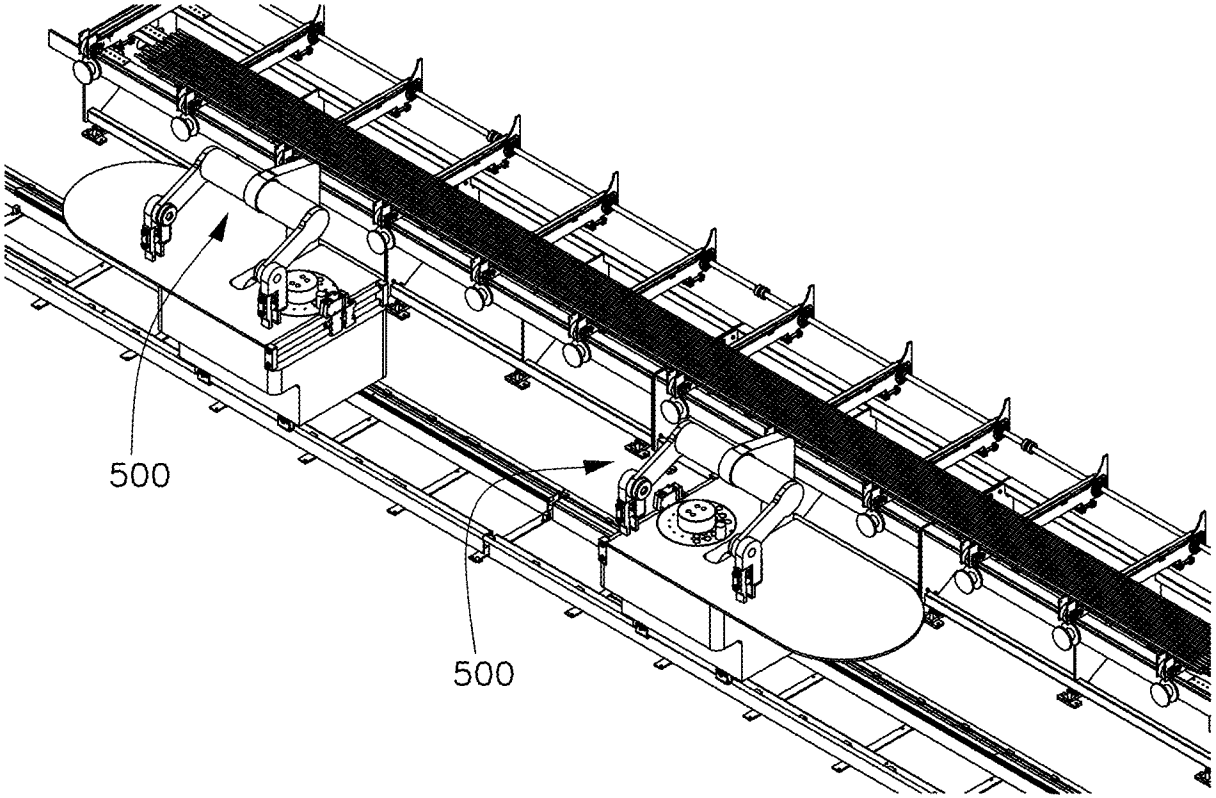
FIG. 16 shows a perspective view of the apparatus according to a further embodiment.
Figure 17A:
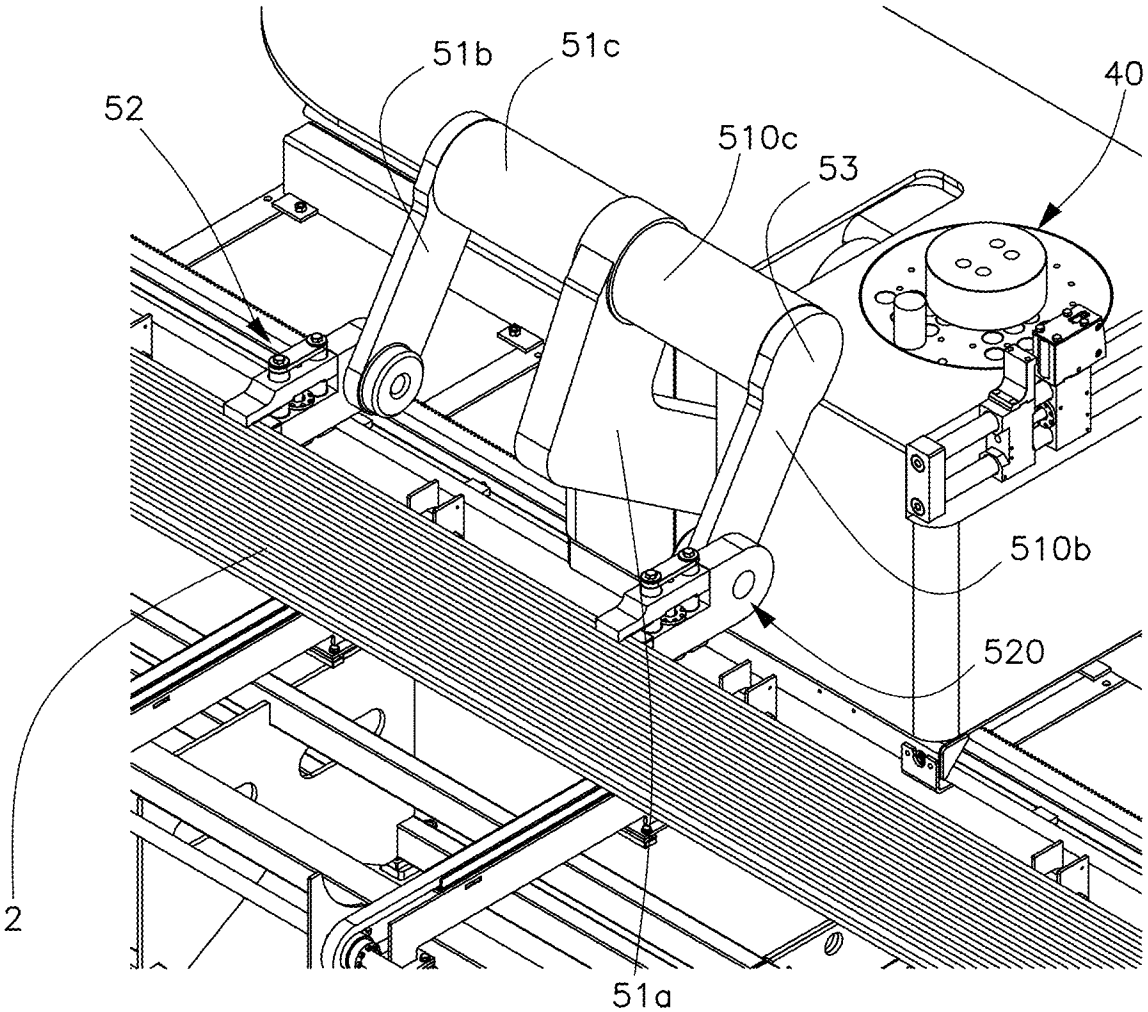
FIGS. 17*a*, 17*b* and 17*c* respectively show an enlarged partial view, a complete view and an enlarged partial view in perspective of the apparatus according to the embodiment shown in FIG. 16, in subsequent operating steps of handling the bars.
Figure 17B:
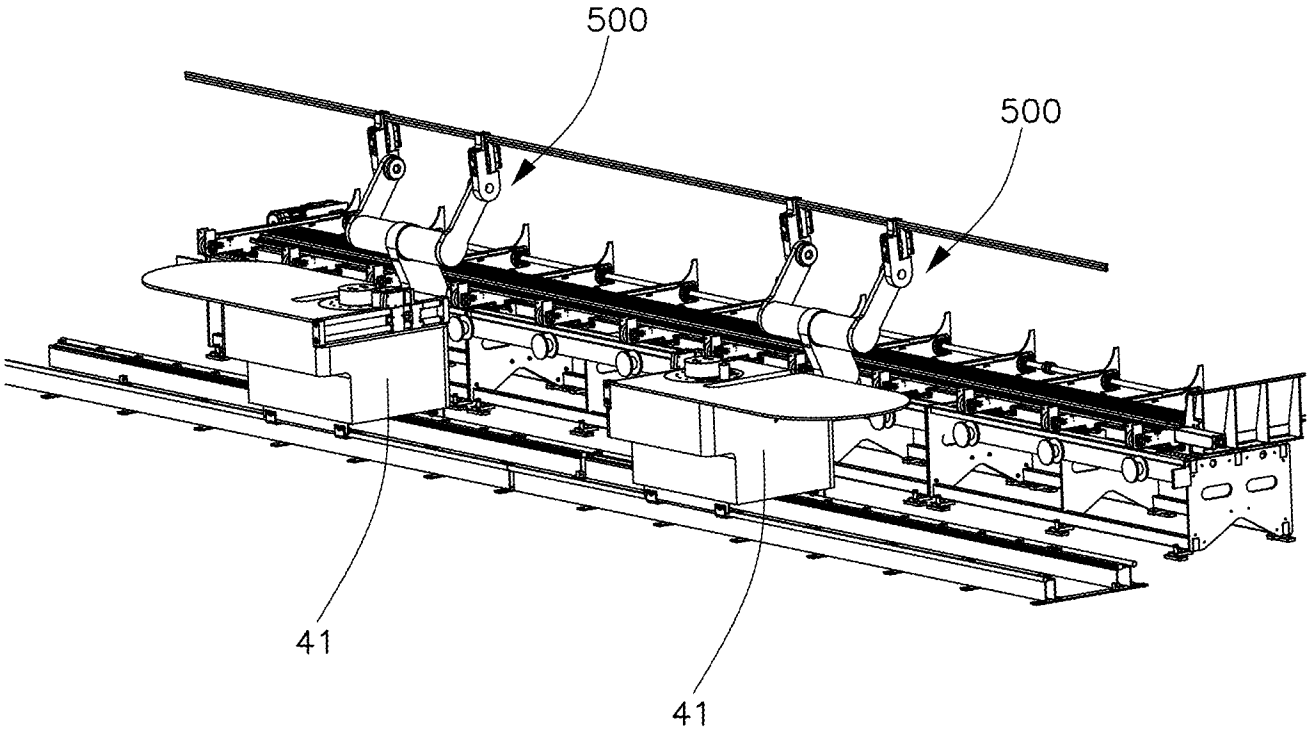
Figure 17C:
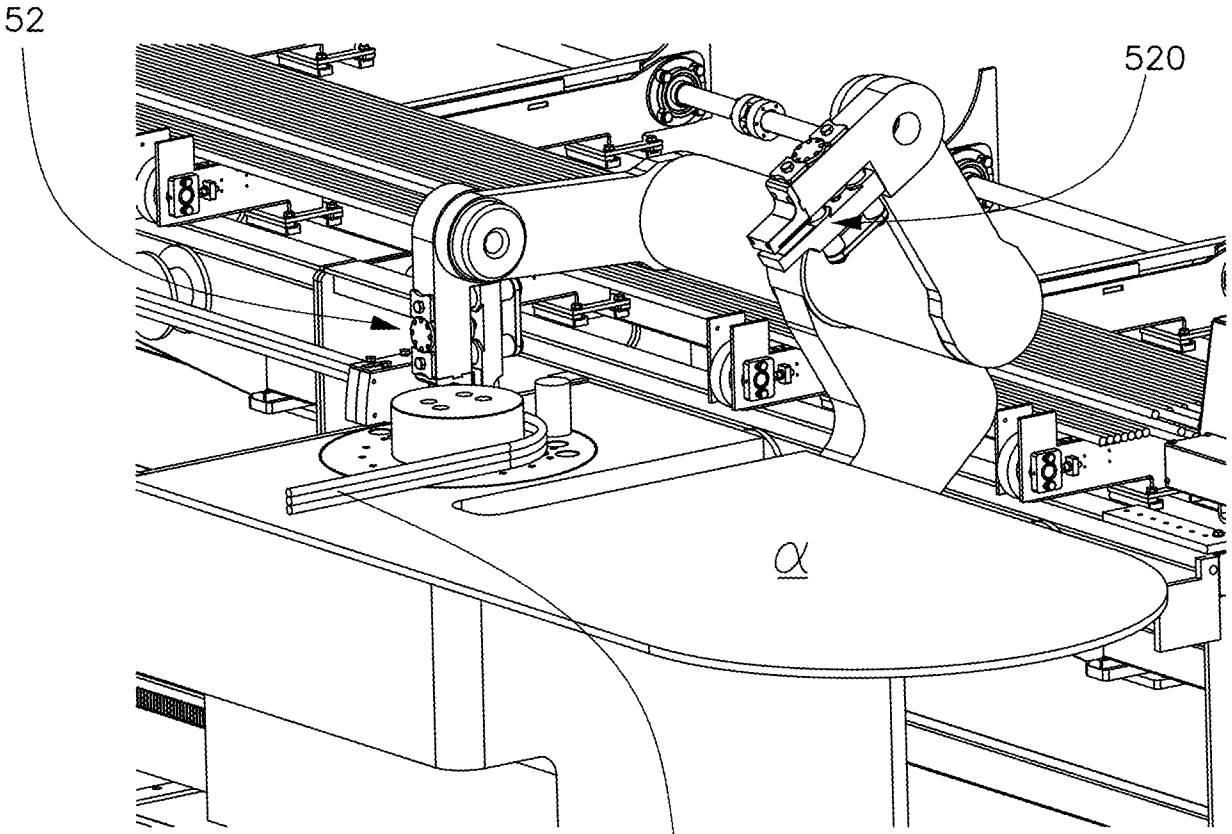

This embodiment, which is for the rest quite similar to that described above, permits to support each number of bars to be processed even with a single transfer device. As illustrated in FIG. 16, it is in fact possible to avoid the use, preferably, of an additional transfer device 50' which is interposed between the bending units 41. Moreover, advantageously, the branches from the common first member 51*a* can be moved independently in order to handle the bars 2 optimally. In particular, for example, in the processing step, the number of bars 2 can be held only by the gripping member 52, while the further gripping member 520 is in a remote position, in which it does not interfere with the bending operations (see FIG. 17*c*).

The apparatus for bending metal section bars in bars according to the invention therefore achieves the purpose of allowing the optimal processing, for example bending, of bars, in particular by reducing the space occupied to the maximum and optimizing production's efficiency.

In the practical embodiment of the invention, the used materials, as well as the shape and the dimensions, may be modified depending on needs.

Should the technical features mentioned in any claim be followed by reference signs, such reference signs were included strictly with the aim of enhancing the understanding of the claims and hence they shall not be deemed restrictive in any manner whatsoever on the scope of each element identified for exemplifying purposes by such reference signs.

The invention claimed is:

1. A method for processing bars, comprising the steps of:

a. arranging a feeding station capable of receiving said bars on a feeding plane along a longitudinal direction, arranging at least one operating unit for processing said bars on a work surface, arranging an unloading station for receiving said processed bars on an unloading surface, and arranging a transfer device interposed between said feeding station and said unloading station, the transfer device comprising an articulated arm constrained at a height below said work surface, and at least one gripping member articulated to said articulated arm at least around an orientation axis parallel to said longitudinal direction, said gripping member comprising a receiving space for a number of said bars and a passage opening, said gripping device being movable between an opening configuration wherein said receiving space is open through said respective passage opening, said number of bars accessing said receiving space or being released out thereof, and a closing configuration wherein said receiving space is closed, to retain said number of bars;

b. feeding said bars onto said feeding plane at said feeding station;

c. positioning the transfer device at said feeding plane and intercepting said number of bars, by operating said gripping member from said opening configuration to said closing configuration;

d. transferring said number of intercepted bars, in a first transfer section, by activating said transfer device in a transfer motion from said feeding plane to said operating unit;

e. releasing said number of bars onto said work surface, actuating said gripping member from said closing configuration to said opening configuration;

f. operating said operating unit for processing said number of bars;

g. collecting by means of said gripping member and transferring said number of processed bars to a second transfer section, by activating said transfer device in said transfer motion from said operating unit to said unloading station;

h. releasing said number of processed bars in said unloading station, by operating said gripping member from said closing configuration to said opening configuration;

i. between said steps b. and h. operating said transfer device by moving said gripping member in an orientation motion at least around said orientation axis so that said gripping member is oriented with said receiving space overlying said passage opening.

2. A method as in claim 1, wherein said orientation motion includes a tilting motion of said gripping member from one side to an opposite side with respect to said articulated arm, so that said gripping member may overcome, by crossing it from above, the space represented by said articulated arm, constrained under said work surface.

3. A method as in claim 1, wherein said orientation motion comprises a combination of rotational motions of said articulated arm around said orientation axis and an intermediate pivot axis of said articulated arm, parallel to said orientation axis.

4. A method as in claim 3, wherein said combination of rotational motions further takes place around a constraint axis parallel to said orientation axis, by means of which said articulated arm is constrained to said portion below said work surface.

5. A method as in claim 1, wherein said step h. of releasing said number of processed bars involves disengaging said number of processed bars with at least partially lifting motion from said unloading surface, thus allowing an orderly support or overlapping of the same in the unloading station.

6. A method as in claim 1, wherein said operating unit comprises a bending and/or curving unit.

7. An apparatus for processing bars, comprising a feeding station capable of receiving said bars on a feeding plane along a longitudinal direction, at least one operating unit for processing said bars on a work surface, an unloading station, to receive on an unloading surface said processed bars, and a transfer device interposed between said feeding station and said unloading station, the transfer device comprising an articulated arm constrained at a level below said work surface and at least one gripping member articulated to said articulated arm at least around an orientation axis parallel to said longitudinal direction, said gripping member comprising a receiving space for a number of said bars and a passage opening and being movable between an opening configuration in which said receiving space is open through a respective passage opening, said number of bars accessing said receiving space or being released out thereof, and a closing configuration in which said receiving space is closed to retain said number of bars, said transfer device being operable in a transfer motion to bring said gripping member in a first transfer section between said feeding station and said operating unit and in a second transfer section between said operating unit and said unloading station, to release said number of said bars respectively on said work surface and on said unloading surface, said transfer device being operable to move said gripping member in an orientation motion at least around said orientation axis, so as to orient said gripping member with said receiving space overlying said passage opening.

8. An apparatus as in claim 7, wherein said gripping member is operable in said orientation motion by overturning the same member from one side to an opposite side with respect to said articulated arm, so as to be above said passage opening.

9. An apparatus as in claim 7, wherein said articulated arm comprises a first member and a second member mutually articulated at least around an intermediate axis parallel to said axis of orientation, wherein said second member is articulated to said gripping member at least around said orientation axis, said transfer device being operable according to a combination of rotational motions around said orientation axis and said intermediate axis, to achieve said orientation movement of said gripping member.

10. An apparatus as in claim 9, wherein said articulated arm is articulated at said height below said work surface at least around a constraint axis parallel to said orientation axis, said transfer device being operable, according to said combination of rotational motions, further around said constraint axis, to achieve said orientation motion of said gripping member.

11. An apparatus as in claim 7, wherein said transfer device is constrained in an internal position to a base of said operating unit, said work surface comprising a notch for enabling said transfer device to emerge from said work surface following said orientation motion.

12. An apparatus as in claim 11, wherein said articulated arm comprises a spacer extending between said first member and said second member and/or between said second member and said gripping member, to bring said gripping member close to an opposite internal side of said operating unit, so as to operate in correspondence with said area.

13. An apparatus as in claim 11, wherein said first member of said articulated arm is shaped like a double elbow.

14. An apparatus as in claim 7, wherein said transfer device is integrated with said operating unit.

15. An apparatus as in claim 7, wherein said transfer motion is transverse to said longitudinal direction.

16. An apparatus as in claim 7, further comprising a further operating unit, which is movable with respect to said operating unit along said longitudinal direction.

17. An apparatus as in claim 7, wherein said operating unit is a bending and/or curving unit, comprising a bending and/or curving head equipped with bending members operating on said work surface, between which an insertion seat is defined for said bars to be bent and/or curved.

18. An apparatus as in claim 7, wherein said gripping member is operable from said oriented configuration, wherein the gripping member is arranged above said work surface or said unloading surface, so as to disengage said number of said bars with at least partially lifting motion from said work surface or from said unloading surface respectively.

19. An apparatus as in claim 7, further comprising at least one further said transfer device configured to cooperate with said transfer device along said longitudinal direction.

20. An apparatus as in claim 7, wherein said gripping member comprises a pair of jaws, at least one of which being movable relative to the other between said opening configuration and said closing configuration, at least one of the jaws internally comprising a recess and a protruding end portion, in said closing configuration one said bar being clamped by said protruding portion and the remaining bars being received by said recess.

21. An apparatus as in claim 7, wherein said articulated arm of said transfer device has said gripping member and a further gripping member.

22. An apparatus as in claim 7, further comprising at least another transfer device to provide a plurality of said transfer devices which are movable along said longitudinal direction, so as to exploit the entire longitudinal extension of said unloading station, for unloading said processed bars in a corresponding longitudinal succession.

23. An apparatus as in claim 7, further comprising, at one side of said feeding plane, at least one additional receiving plane dedicated to receiving bars cut to size coming from a further source.

* * * * *